US011574598B2

(12) United States Patent
Chang et al.

(10) Patent No.: US 11,574,598 B2
(45) Date of Patent: Feb. 7, 2023

(54) GATE DRIVER CIRCUIT AND DISPLAY DEVICE INCLUDING THE SAME

(71) Applicant: LG Display Co., Ltd., Seoul (KR)

(72) Inventors: Minkyu Chang, Incheon (KR); Miyoung Son, Goyang-si (KR); Hongjae Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/504,999

(22) Filed: Oct. 19, 2021

(65) Prior Publication Data

US 2022/0208104 A1 Jun. 30, 2022

(30) Foreign Application Priority Data

Dec. 31, 2020 (KR) ..... 10-2020-0189165

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2300/0809* (2013.01); *G09G 2300/0842* (2013.01); *G09G 2310/061* (2013.01); *G09G 2310/08* (2013.01); *G09G 2320/0214* (2013.01)

(58) Field of Classification Search
None
See application file for complete search history.

(56) References Cited

U.S. PATENT DOCUMENTS

| | | | | |
|---|---|---|---|---|
| 10,546,520 | B2 | 1/2020 | Noh et al. | |
| 2014/0085285 | A1* | 3/2014 | Kim | G11C 19/28 377/67 |
| 2018/0337682 | A1* | 11/2018 | Takasugi | H03K 21/18 |
| 2019/0043405 | A1 | 2/2019 | Noh et al. | |
| 2020/0074933 | A1* | 3/2020 | Ban | G09G 3/3283 |
| 2020/0074937 | A1* | 3/2020 | Choi | G09G 3/3266 |
| 2020/0135115 | A1* | 4/2020 | Chang | G09G 3/3266 |
| 2022/0199034 | A1* | 6/2022 | Yun | G09G 3/3266 |
| 2022/0208109 | A1* | 6/2022 | Seo | G09G 3/3233 |
| 2022/0208112 | A1* | 6/2022 | Kim | G09G 3/3266 |

FOREIGN PATENT DOCUMENTS

| | | | |
|---|---|---|---|
| KR | 10-2007-0002776 | A | 1/2007 |
| KR | 10-2019-0014842 | A | 2/2019 |

* cited by examiner

*Primary Examiner* — Nitin Patel
*Assistant Examiner* — Amen W Bogale
(74) *Attorney, Agent, or Firm* — Fenwick & West LLP

(57) ABSTRACT

Disclosed are a gate driver circuit having a reduced size, and a display device including the same. The gate driver circuit includes a plurality of stage circuits. Each stage circuit supplies a gate signal to each of gate lines arranged in a display panel, and includes a M node, a Q node, a QH node, and a QB node. Each stage circuit includes a gate signal output module configured to operate based on a voltage level of the Q node or a voltage level of the QB node to output first to j-th gate signals based on first to j-th scan clock signals or a first low-potential voltage.

20 Claims, 12 Drawing Sheets

GATE DRIVER CIRCUIT AND DISPLAY DEVICE INCLUDING THE SAME

CROSS-REFERENCE TO RELATED APPLICATION

This application claims priority to and the benefit of Republic of Korea Patent Application No. 10-2020-0189165, filed in the Republic of Korea on Dec. 31, 2020, the entire contents of which are incorporated by reference in its entirety.

FIELD

The present disclosure relates to a gate driver circuit having a reduced size, and a display device including the same.

DESCRIPTION OF RELATED ART

Recently, a display device using a flat display panel such as a liquid crystal display device, an organic light-emitting display device, a light-emissive diode display device, and an electrical electrophoretic display device has been widely used.

A display device may include a pixel having a light-emissive element and a pixel circuit for driving the light-emissive element. For example, the pixel circuit includes a driving transistor that controls a driving current flowing through the light-emissive element, and at least one switching transistor that controls (or programs) a gate-source voltage of the driving transistor according to a gate signal. The switching transistor of the pixel circuit may be switched based on the gate signal output from a gate driver circuit disposed on a substrate of a display panel.

The display device includes a display area where an image is displayed and a non-display area where an image is not displayed. As a size of the non-display area decreases, a size of an edge area or a bezel area of a display device decreases while a size of the display area thereof increases.

SUMMARY

A gate driver circuit is disposed in the non-display area of the display device. As a size of the gate driver circuit decreases, a size of the display area increases.

The gate driver circuit includes a plurality of stage circuits. Each stage circuit includes a plurality of transistors for generating a gate signal. As the number of the transistors included in each stage circuit increases, a size of the stage circuit and thus a size of the gate driver circuit increase. Therefore, in order to reduce the size of the gate driver circuit and increase the size of the display area, it is necessary to reduce the number of the transistors included in each stage circuit.

Further, as the number of operations of a transistor included in each stage circuit increases, characteristics of the transistor, for example, a magnitude of a threshold voltage thereof change. Thus, as the magnitude of the threshold voltage thereof changes, a voltage drop at a control node occurs such that the transistor is not maintained in a completely turned-off state. Thus, leakage current occurs in each stage circuit during the operation of the gate driver circuit. When a gate signal is not output normally due to the leakage current, an image quality of the display device is deteriorated.

The present disclosure provides embodiments for solving the above-described technical problem.

A purpose of the present disclosure is to provide a gate driver circuit having a reduced size due to decrease in the number of transistors constituting a stage circuit and the number of lines connected to the transistors, and a display device including the same in which a display area thereof is increased.

Further, a purpose of the present disclosure is to provide a gate driver circuit having improved durability and reliability in which a voltage stress of a transistor included in a stage circuit is lowered to extend a lifespan of the transistor, and a display device including the same.

Purposes according to the present disclosure are not limited to the above-mentioned purpose. Other purposes and advantages according to the present disclosure that are not mentioned may be understood based on following descriptions, and may be more clearly understood based on embodiments according to the present disclosure. Further, it will be easily understood that the purposes and advantages according to the present disclosure may be realized using means shown in the claims and combinations thereof.

According to one embodiment of the present disclosure, the number of the transistors constituting the stage circuit of the gate driver circuit and the number of lines connected to the transistors may be reduced, while stable operation of the gate driver circuit may be ensured. When the number of the transistors constituting the stage circuit decreases, the size of the gate driver circuit decreases, and thus the size of the display area of the display device increases. Further, a configuration and a design of the stage circuit become simpler due to the reduction in the number of the transistors constituting the stage circuit.

In one embodiment, a gate driver circuit for a display device comprises: a plurality of stage circuits, wherein at least one stage circuit from the plurality of stage circuits supplies a gate signal to a gate line, the at least one stage circuit including: a plurality of nodes comprising a M node, a Q node, a QH node, and a QB node; a line selector configured to: charge the M node based on a front carry signal responsive to an input of a line sensing preparation signal; and charge the Q node to a first high-potential voltage level responsive to an input of a rest signal or discharge the Q node to a third low-potential voltage level responsive to an input of a panel on signal; a Q node controller configured to: charge the Q node to the first high-potential voltage level responsive to an input of the front carry signal; and discharge the Q node to the third low-potential voltage level responsive to an input of a rear carry signal; a Q node and QH node stabilizer configured to discharge each of the Q node and the QH node to the third low-potential voltage level responsive to the QB node being charged to a second high-potential voltage; an inverter configured to change a voltage level of the QB node based on a voltage level of the Q node; a QB node stabilizer configured to discharge the QB node to the third low-potential voltage level responsive to an input of the rear carry signal, an input of the rest signal, and a charged voltage of the M node; a carry signal output module configured to output a carry signal based on a carry clock signal or the third low-potential voltage and based on the voltage level of the Q node or the voltage level of the QB node; and a gate signal output module configured to output first to j-th gate signals based on first to j-th scan clock signals or a first low-potential voltage and based on the voltage level of the Q node or the voltage level of the QB node.

In one embodiment, a display device comprises: a display panel including sub-pixels respectively disposed at intersections between gate lines and data lines; a gate driver circuit configured to supply a scan signal to each gate line from the gate lines; a data driver circuit configured to supply a data voltage to each data line from the data lines; and a timing controller configured to control an operation of each of the gate driver circuit and the data driver circuit. The gate driver circuit includes a plurality of stage circuits, wherein at least one stage circuit from the plurality of stage circuits supplies a gate signal to a gate line, the at least one stage circuit including: a plurality of nodes comprising a M node, a Q node, a QH node, and a QB node; a line selector configured to: charge the M node based on a front carry signal responsive to an input of a line sensing preparation signal; and charge the Q node to a first high-potential voltage level responsive to an input of a rest signal or discharge the Q node to a third low-potential voltage level responsive to an input of a panel on signal; a Q node controller configured to: charge the Q node to the first high-potential voltage level responsive to an input of the front carry signal; and discharge the Q node to the third low-potential voltage level responsive to an input of a rear carry signal; a Q node and QH node stabilizer configured to discharge each of the Q node and the QH node to the third low-potential voltage level responsive to the QB node being charged to a second high-potential voltage; an inverter configured to change a voltage level of the QB node based on a voltage level of the Q node; a QB node stabilizer configured to discharge the QB node to the third low-potential voltage level responsive to an input of the rear carry signal, an input of the rest signal, and a charged voltage of the M node; a carry signal output module configured to output a carry signal based on a carry clock signal or the third low-potential voltage and based on the voltage level of the Q node or the voltage level of the QB node; and a gate signal output module configured to output first to j-th gate signals based on first to j-th scan clock signals or a first low-potential voltage and based on the voltage level of the Q node or the voltage level of the QB node.

In one embodiment, a gate driver circuit for a display device comprises: a plurality of stage circuits, wherein at least one stage circuit from the plurality of stage circuits is configured to supply a gate signal to a gate line, the at least one stage circuit including: a plurality of transistors arranged to form a plurality of nodes between the plurality of transistors, the plurality of nodes including a Q node, a QH node, and a QB node; wherein the Q node is configured to be charged and discharged between a first high-potential voltage and a third low-potential voltage, wherein the QH node is configured to be charged and discharged between the third low-potential voltage and a second high-potential voltage, a magnitude of the second high-potential voltage adjusted based on an operation time duration of the gate driver circuit; and wherein the QB node is configured to be charged and discharged between a voltage of the Q node and the third-low potential voltage.

Further, according to one embodiment of the present disclosure, the magnitude of the voltage input to the transistor included in the stage circuit may be adjusted based on the operation time duration of the display device. Therefore, the voltage stress of the transistor may be reduced and thus the lifespan of the transistor may be extended. Accordingly, the durability of each of the gate driver circuit and the display device may be improved, and the operation reliability of each of the gate driver circuit and the display device may be improved.

Effects of the present disclosure are not limited to the above-mentioned effects, and other effects as not mentioned will be clearly understood by those skilled in the art from following descriptions.

DETAILED DESCRIPTION

Figure 1:
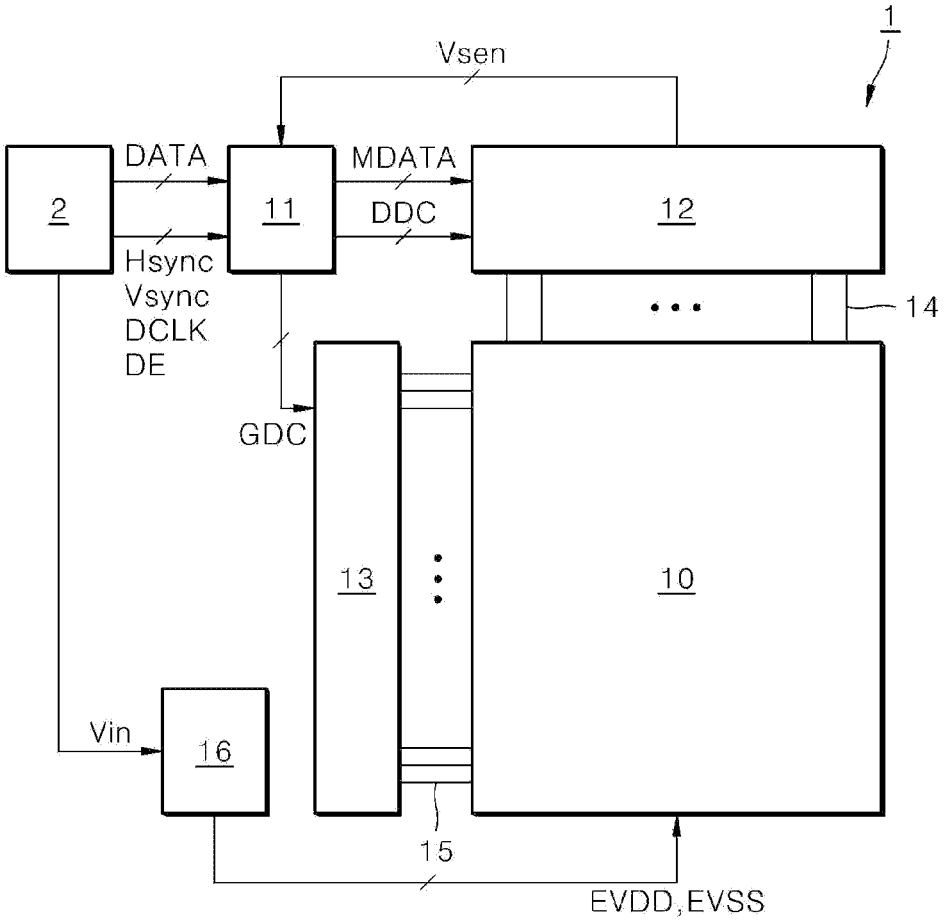
FIG. 1 is a block diagram showing a configuration of a display device according to one embodiment of the present disclosure.

For simplicity and clarity of illustration, elements in the drawings are not necessarily drawn to scale. The same reference numbers in different drawings represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various embodiments are illustrated and described further below. It will be understood that the description herein is not intended to limit the claims to the specific embodiments described. On the contrary, it is intended to cover alternatives, modifications, and equivalents as may be within the spirit and scope of the present disclosure as defined by the appended claims.

A shape, a size, a ratio, an angle, a number, etc. disclosed in the drawings for describing an embodiments of the present disclosure are exemplary, and the present disclosure is not limited thereto. The same reference numerals refer to the same elements herein. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

The terminology used herein is for the purpose of describing particular embodiments only and is not intended to limit the present disclosure. As used herein, the singular may constitute "a" and "an" are intended to include the plural may constitute as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entirety of list of elements and may not modify the individual elements of the list. When referring to "C to D", this means C inclusive to D inclusive unless otherwise specified.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The features of the various embodiments of the present disclosure may be partially or entirely combined with each other, and may be technically associated with each other or operate with each other. An embodiments may be implemented independently of each other and may be implemented together in an association relationship.

In interpreting a numerical value in the disclosure, an error range may be inherent even when there is no separate explicit description thereof.

In a description of a signal flow relationship, for example, when a signal is transmitted from a node A to a node B, the signal may be transmitted from the node A via a node C to the node B, unless an indication that the signal is transmitted directly from the node A to the node B is specified.

In accordance with the present disclosure, each of a sub-pixel circuit and a gate driver circuit formed on a substrate of a display panel may be embodied as a transistor of an n-type MOSFET structure. However, the disclosure is not limited thereto. Each of a sub-pixel circuit and a gate driver circuit formed on a substrate of a display panel may be embodied as a transistor of a p-type MOSFET structure. A transistor may include a gate, a source, and a drain. In the transistor, carriers may flow from the source to the drain. In an n-type transistor, the carrier is an electron and thus a source voltage may be lower than a drain voltage so that electrons may flow from the source to the drain. In an n-type transistor, electrons flow from the source to the drain. A current direction is a direction from the drain to the source. In a p-type transistor, the carrier is a hole. Thus, the source voltage may be higher than the drain voltage so that holes may flow from the source to the drain. In the p-type transistor, the holes flow from the source to the drain. Thus, a direction of current is a direction from the source to the drain. In the transistor of the MOSFET structure, the source and the drain may not be fixed, but may be changed according to an applied voltage. Accordingly, in the present disclosure, one of the source and the drain is referred to as a first source/drain electrode, and the other of the source and the drain is referred to as a second source/drain electrode.

Hereinafter, one example of a gate driver circuit and a display device including the same according to the present disclosure will be described in detail with reference to the accompanying drawings. Across different drawings, the same elements may have the same reference numerals. Moreover, each of scales of components shown in the accompanying drawings is shown to be different from an actual scale for convenience of description. Thus, each of scales of components is not limited to a scale shown in the drawings.

Figure 2:
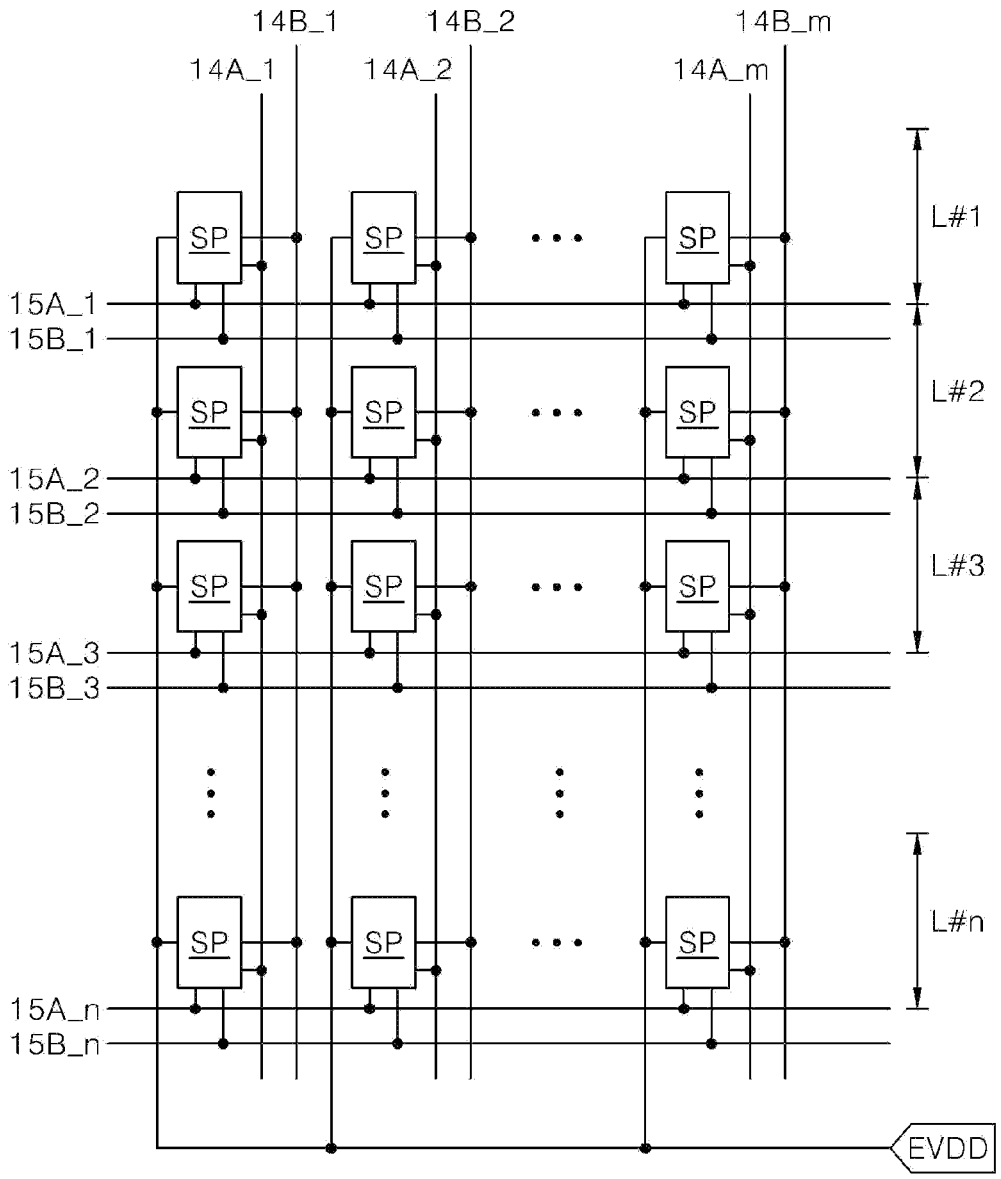
FIG. 2 shows a configuration of a sub-pixel array included in a display panel according to one embodiment of the present disclosure.

FIG. 1 is a block diagram showing a configuration of a display device according to one embodiment of the present disclosure. FIG. 2 shows a configuration of a sub-pixel array included in a display panel according to one embodiment of the present disclosure.

Referring to FIG. 1 and FIG. 2, a display device 1 according to one embodiment of the present disclosure includes a display panel 10, a data driver circuit 12, a gate driver circuit 13, and a timing controller 11.

A plurality of data lines 14 and a plurality of gate lines 15 are arranged to intersect each other and on the display panel 10. Further, sub-pixels SP are arranged in a matrix form and are respectively disposed at intersections between the data lines 14 and the gate lines 15.

The data lines 14 includes m data voltage supply lines 14A_1 to 14A_m (m being a positive integer) and m sensed voltage readout lines 14B_1 to 14B_m. Moreover, the gate lines 15 include n (n being positive integer) first gate lines 15A_1 to 15A_n and n second gate lines 15B_1 to 15B_n.

Each sub-pixel SP may be connected to one of the data voltage supply lines 14A_1 to 14A_m, one of the sensed voltage readout lines 14B_1 to 14B_m, one of the first gate lines 15A_1 to 15A_n, and one of the second gate lines 15B_1 to 15B_n. The sub-pixels SP may display different colors. A certain number of sub-pixel SPs may constitute one pixel P.

Each sub-pixel SP may receive a data voltage through the data voltage supply line, may receive a first gate signal through the first gate line, may receive a second gate signal through the second gate line, and may output a sensed voltage through the sensed voltage readout line.

That is, in the sub-pixel array shown in FIG. 2, the sub-pixels SP may operate on one horizontal line L #1 to L #n basis in response to the first gate signal supplied on a horizontal line basis from the first gate lines 15A_1 to 15A_n and the second gate signal supplied on a horizontal line basis from the second gate lines 15B_1 to 15B_n. Sub-pixels SP on the same horizontal line where a sensing operation is activated may receive a data voltage for sensing a threshold voltage from the data voltage supply lines 14A_1 to 14A_m and outputs a sensed voltage to the sensed voltage readout lines 14B_1 to 14B_m. Each of the first gate signal and the second gate signal may be a gate signal for sensing the threshold voltage or a gate signal for displaying an image, respectively. The present disclosure is not limited thereto.

Each sub-pixel SP may receive a high-potential voltage EVDD and a low-potential voltage EVSS from a power management circuit 16. The sub-pixel SP may include an organic light emitting diode (OLED), a driving transistor, first and second switching transistors, and a storage capacitor. According to an embodiment, a light source other than the OLED may be included in the sub-pixel SP.

Each of the transistors constituting the sub-pixel SP may be implemented as a p-type or n-type transistor. Further, a semiconductor layer of each of the transistors constituting the sub-pixel SP may include amorphous silicon or polysilicon or an oxide.

During the image display operation, the data driver circuit 12 converts compensated image data MDATA input from the timing controller 11 based on a data control signal DDC into a data voltage for image display and supplies the converted data voltage to the data voltage supply lines 14A_1 to 14A_m.

During a sensing operation for sensing a threshold voltage of the driving transistor, the data driver circuit 12 may transmit a data voltage for sensing the threshold voltage to the sub-pixels SP, based on the first gate signal for sensing the threshold voltage supplied on a horizontal line basis and may convert a sensed voltage input from the display panel 10 via the sensed voltage readout lines 14B_1 to 14B_m into a digital value and may supply the converted digital value to the timing controller 11.

The gate driver circuit 13 generates the gate signal based on a gate control signal GDC. The gate signal may include the first gate signal for sensing the threshold voltage, the second gate signal for sensing the threshold voltage, a first gate signal for displaying an image, and a second gate signal for displaying an image.

During the sensing operation, the gate driver circuit 13 may supply the first gate signal for sensing the threshold voltage to the first gate lines 15A_1 to 15A_n on a horizontal line basis, and may supply the second gate signal for sensing the threshold voltage to the second gate lines 15B_1 to 15B_n on a horizontal line basis. During the image display operation for image display, the gate driver circuit 13 may supply the first gate signal to display the image to the first gate lines 15A_1 to 15A_n on a horizontal line basis, and may supply the second gate signal to display the image to the second gate lines 15B_1 to 15B_n on a horizontal line basis. In one embodiment of the present disclosure, the gate driver circuit 13 may be disposed on the display panel 10 in a GIP (Gate-driver In Panel) scheme.

The timing controller 11 may generate and output the data control signal DDC for controlling an operation timing of the data driver circuit 12 and the gate control signal GDC for controlling an operation timing of the gate driver circuit 13, based on timing signals such as a vertical synchronization signal Vsync, a horizontal synchronization signal Hsync, a dot clock signal DCLK, and a data enable signal DE which are transmitted from a host system 2. Further, the timing controller 11 compensates image data DATA transmitted from the host system 2 based on a sensed value supplied from the data driver circuit 12 to generate compensated image data MDATA for compensating for a threshold voltage deviation of the driving transistor, and supplies the compensated image data MDATA to the data driver circuit 12.

The power management circuit 16 generates and supplies a voltage necessary for operation of the display device 1 based on the power supplied from the host system 2. In one embodiment of the present disclosure, the power management circuit 16 generates a driving voltage EVDD and a base voltage EVSS necessary for the operation of each sub-pixel SP, based on an input voltage Vin supplied from the host system 2, and supplies the driving voltage EVDD and the base voltage EVSS to the display panel 10. In still another example, the power management circuit 16 may generate a gate driving voltage GVDD and a gate base voltage GVSS necessary for operation of the gate driver circuit 13, and supply the gate driving voltage GVDD and the gate base voltage GVSS to the gate driver circuit 13.

Figure 3:
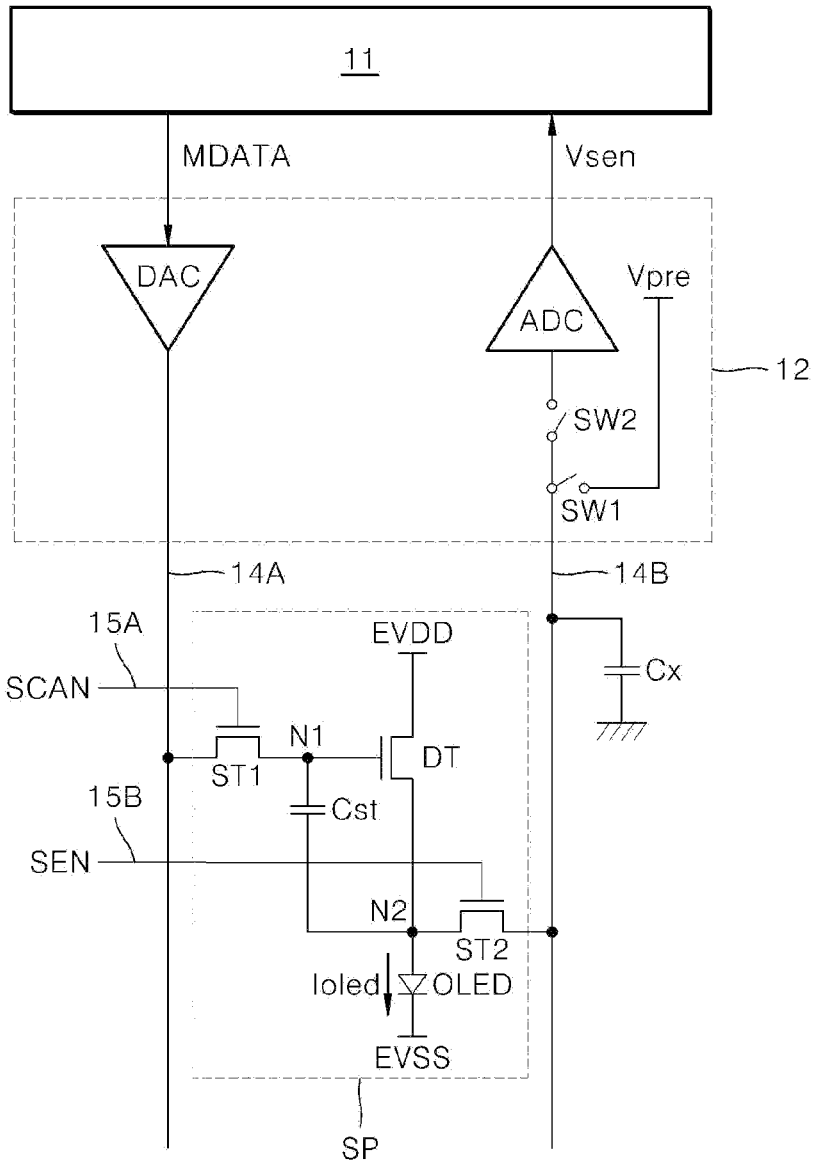
FIG. 3 shows a configuration of a sub-pixel circuit, and a connection structure between a timing controller, a data driver circuit, and a sub-pixel according to one embodiment of the present disclosure.

FIG. 3 shows a configuration of a sub-pixel circuit, and a connection structure between a timing controller, a data driver circuit, and a sub-pixel according to one embodiment of the present disclosure.

Referring to FIG. 3, the sub-pixel SP includes the OLED, the driving transistor DT, the storage capacitor Cst, the first switching transistor ST, and the second switching transistor ST2.

The OLED includes an anode connected to a second node N2, a cathode connected to an input side of a low-potential driving voltage EVSS, and an organic compound layer located between the anode and the cathode.

The driving transistor DT is turned on based on a gate-source voltage Vgs to control a current Ioled flowing through the OLED. The driving transistor DT includes a gate electrode connected to a first node N1, a drain electrode connected to an input side of a high-potential driving voltage EVDD, and a source electrode connected to the second node N2.

The storage capacitor Cst is connected to and disposed between the first node N1 and the second node N2.

The first switching transistor ST1 applies a data voltage Vdata for sensing a threshold voltage as charged in the data voltage supply line 14A to the first node N1 in response to the first gate signal SCAN for sensing the threshold voltage, during the sensing operation.

The first switching transistor ST1 applies a data voltage Vdata for displaying an image charged in the data voltage supply line 14A to the first node N1 in response to the first gate signal SCAN for displaying the image, during an image display operation. The first switching transistor ST1 includes a gate electrode connected to the first gate line 15A, a drain electrode connected to the data voltage supply line 14A, and a source electrode connected to the first node N1.

During the sensing operation, the second switching transistor ST2 switches a current flow between the second node N2 and the sensed voltage readout line 14B in response to the second gate signal SEN for sensing the threshold voltage such that a source voltage of the second node N2 which changes based on a gate voltage of the first node N1 is stored in a sensing capacitor Cx of the sensed voltage readout line 14B.

During the image display operation, the second switching transistor ST2 switches a current flow between the second node N2 and the sensed voltage readout line 14B in response to the second gate signal SEN for displaying the image to reset a source voltage of the driving transistor DT to an initialization voltage Vpre. The gate electrode of the second switching transistor ST2 may be connected to the second gate line 15B. The drain electrode of the second switching transistor ST2 may be connected to the second node N2. The source electrode of the second switching transistor ST2 may be connected to the sensed voltage readout line 14B.

The data driver circuit 12 is connected to the sub-pixel SP via the data voltage supply line 14A and the sensed voltage readout line 14B. The sensing capacitor Cx is connected to the sensed voltage readout line 14B to store therein a source voltage of the second node N2 as a sensed voltage Vsen. The data driver circuit 12 includes a digital-analog converter DAC, an analog-digital converter ADC, an initialization switch SW1, and a sampling switch SW2.

The DAC may generate the data voltage Vdata for sensing the threshold voltage at the same level or different levels for first and second periods of a sensing period under control of the timing controller 11 and output the generated data voltage to the data voltage supply line 14A. The DAC may convert the compensated image data MDATA to a data voltage Vdata for image display under control of the timing controller 11 for the image display period and output the converted data voltage to the data voltage supply line 14A.

The initialization switch SW1 switches current flow between an input side of the initialization voltage Vpre and the sensed voltage readout line 14B. The sampling switch SW2 switches current flow between the sensed voltage readout line 14B and the ADC. The ADC may convert an analog sensed voltage Vsen stored in the sensing capacitor Cx into a digital value and may supply the digital sensed value to the timing controller 11.

A sensing operation process performed under control of the timing controller 11 is as follows. For the sensing operation, when the first and second gate signals SCAN and SEN for sensing the threshold voltage are applied to the sub-pixel SP while being at an on level Lon, the first switching transistor ST1 and the second switching transistor ST2 are turned on. In this connection, the initialization switch SW1 in the data driver circuit 12 is turned on.

When the first switching transistor ST1 is turned on, the data voltage Vdata for sensing the threshold voltage is supplied to the first node N1. When the initialization switch SW1 and the second switching transistor ST2 are turned on, the initialization voltage Vpre is supplied to the second node N2. In this connection, the voltage Vgs between the gate and the source of the driving transistor DT becomes larger than a threshold voltage Vth, such that a current Ioled flows between the drain and the source of the driving transistor DT. A source voltage VN2 of the driving transistor DT charged in the second node N2 may gradually increase due to this current Ioled. Thus, the source voltage VN2 of the driving transistor DT may follow a gate voltage VN1 of the driving transistor DT until the gate-source voltage Vgs of the driving transistor DT becomes the threshold voltage Vth.

The source voltage VN2 of the driving transistor DT charged in the second node N2 in the increasing manner is stored as the sensed voltage Vsen in the sensing capacitor Cx formed in the sensed voltage readout line 14B via the second switching transistor ST2. The sensed voltage Vsen may be detected when the sampling switch SW2 in the data driver circuit 12 is turned on within the sensing period for which the second gate signal SEN for sensing the threshold voltage is maintained at the on level, and then the sensed voltage Vsen as detected may be supplied to the ADC.

The ADC converts the analog sensed voltage Vsen stored in the sensing capacitor Cx into a sensing value as a digital value, and supplies the digital sensed value to the timing controller 11.

In one embodiment of the present disclosure, the timing controller 11 may control the data driver circuit 12 and the gate driver circuit 13 so that a sensing operation on one horizontal line is performed for a blank period, that is, a period between a period for which one frame of the image data is displayed for the image display operation and a period in which one subsequent frame thereof is displayed.

The timing controller 11 compensates for the image data DATA based on the sensed value obtained by the data driver circuit 12 and generates the compensated image data MDATA. As the compensated image data MDATA is supplied to the data driver circuit 12, an image based on the compensated image data MDATA is displayed on the display panel 10.

Figure 4:
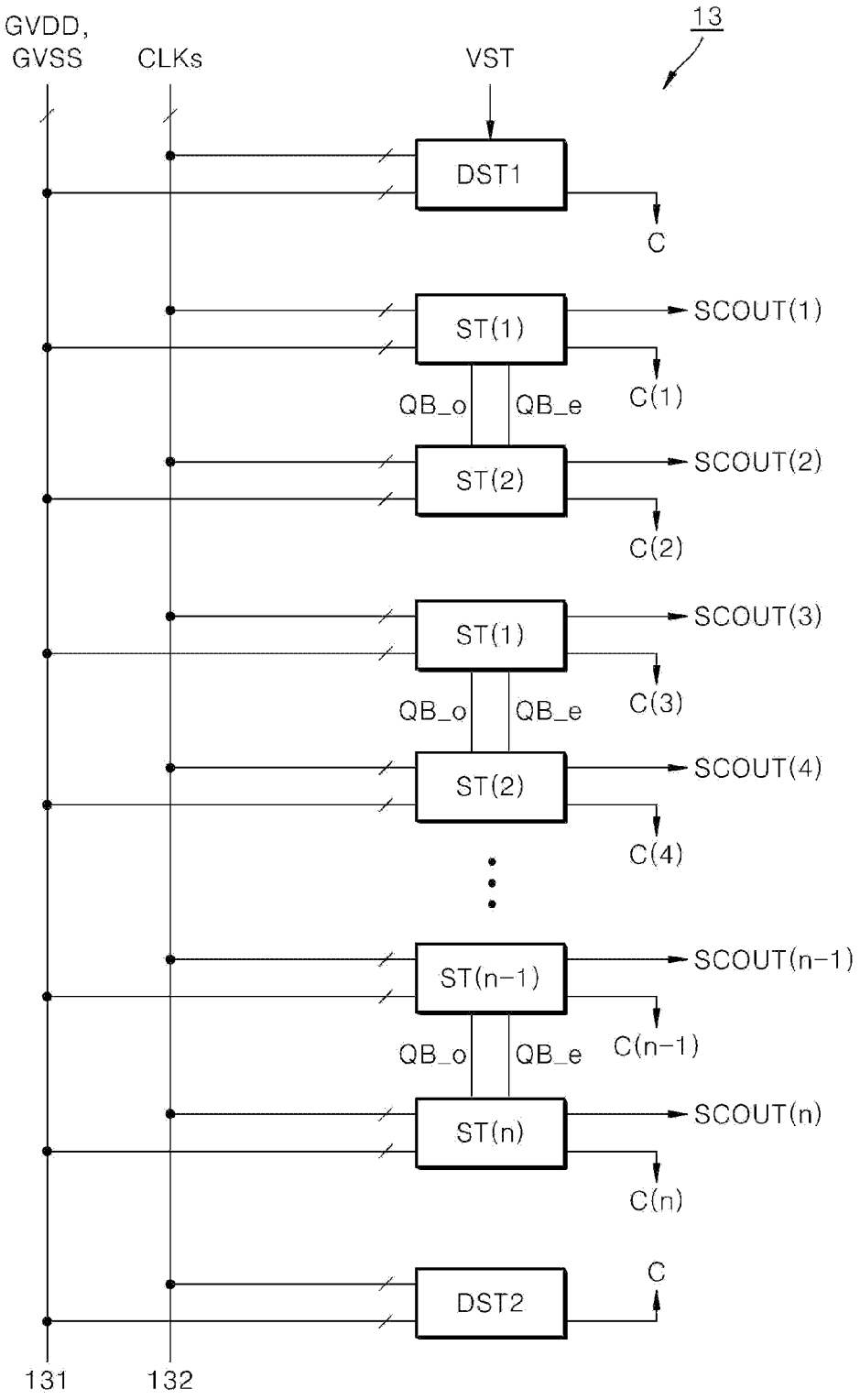
FIG. 4 shows a configuration of a plurality of stage circuits included in a gate driver circuit according to one embodiment of the present disclosure.

FIG. 4 shows a configuration of a plurality of stage circuits included in the gate driver circuit according to one embodiment of the present disclosure.

Referring to FIG. 4, the gate driver circuit 13 according to one embodiment of the present disclosure includes first to n-th stage circuits ST(1) to ST(n), a gate driving voltage line 131, and a clock signal line 132. Further, the gate driver circuit 13 may further include a front dummy stage circuit DST1 disposed in front of the first stage circuit ST(1) and a rear dummy stage circuit DST2 disposed in rear of the n-th stage circuit ST(n).

The gate driving voltage line 131 supplies the high-potential voltage GVDD and the low-potential voltage GVSS supplied from the power supply circuit (not shown) to each of the first to n-th stage circuits ST(1) to ST(n), the front dummy stage circuit DST1, and the rear dummy stage circuit DST2.

In one embodiment of the present disclosure, the gate driving voltage line 131 may include a plurality of high-potential voltage lines for respectively supplying a plurality of high-potential voltages with different voltage levels, and a plurality of low-potential voltage lines for respectively supplying a plurality of low-potential voltages having different voltage levels.

The clock signal line 132 may supply a plurality of clock signals CLK supplied from the timing controller 11, for example, a carry clock signal CRCLK or a scan clock signal SCCLK to each of the first to n-th stage circuits ST(1) to ST(n), the front dummy stage circuit DST1, and the rear dummy stage circuit DST2.

Although not shown, lines for supplying other signals other than the lines 131 and 132 as shown in FIG. 4 may be connected to the first to n-th stage circuits ST(1) to ST(n), the front dummy stage circuit DST1, and the rear dummy stage circuit DST2. For example, a line for supplying a gate start signal VST to the front dummy stage circuit DST1 may be additionally connected to the front dummy stage circuit DST1.

The front dummy stage circuit DST1 outputs a front carry signal C in response to an input of the gate start signal VST supplied from the timing controller 11. The front carry signal C may be supplied to one of the first to n-th stage circuits ST(1) to ST(n).

The rear dummy stage circuit DST2 outputs a rear carry signal C. The rear carry signal C may be supplied to one of the first to n-th stage circuits ST(1) to ST(n).

The first to n-th stage circuits ST(1) to ST(n) may be connected to each other in a cascaded manner or in a stepwise manner.

In the embodiment shown in FIG. 4, each stage circuit outputs one gate signal SCOUT and one carry signal C. For example, a first stage circuit ST(1) outputs a first gate signal SCOUT(1) and a first carry signal C(1). A second stage circuit ST(2) outputs a second gate signal SCOUT(2) and a second carry signal C(2), and so on.

Further, in the embodiment shown in FIG. 4, the two stage circuits share a QB_o node and a QB_e node with each other. For example, the first stage circuit ST(1) and the second stage circuit ST 2 share a QB_o node and a QB_e node with each other. A third stage circuit ST(3) and a fourth stage circuit ST(4) share a QB_o node and a QB_e node with each other.

The number of gate signals output from the first to n-th stage circuits ST(1) to ST(n) may be equal to the number n of the gate lines 15 arranged in the display panel 106. Therefore, in the embodiment shown in FIG. 4, the number n of the first to n-th stage circuits ST(1) to ST(n) may be equal to the number n of the gate lines 15.

The gate signal SCOUT output from each of the first to n-th stage circuits ST(1) to ST(n) may act as a gate signal for sensing a threshold voltage or a gate signal for displaying an image. Further, each carry signal C output from each of the first to n-th stage circuits ST(1) to ST(n) may be supplied to a stage circuit other than each stage circuit. In the present disclosure, a carry signal which one stage circuit receives from another stage circuit in front thereof may be referred to as a front carry signal, while a carry signal which one stage circuit receives from another stage circuit in rear thereof may be referred to as a rear carry signal.

Figure 5:
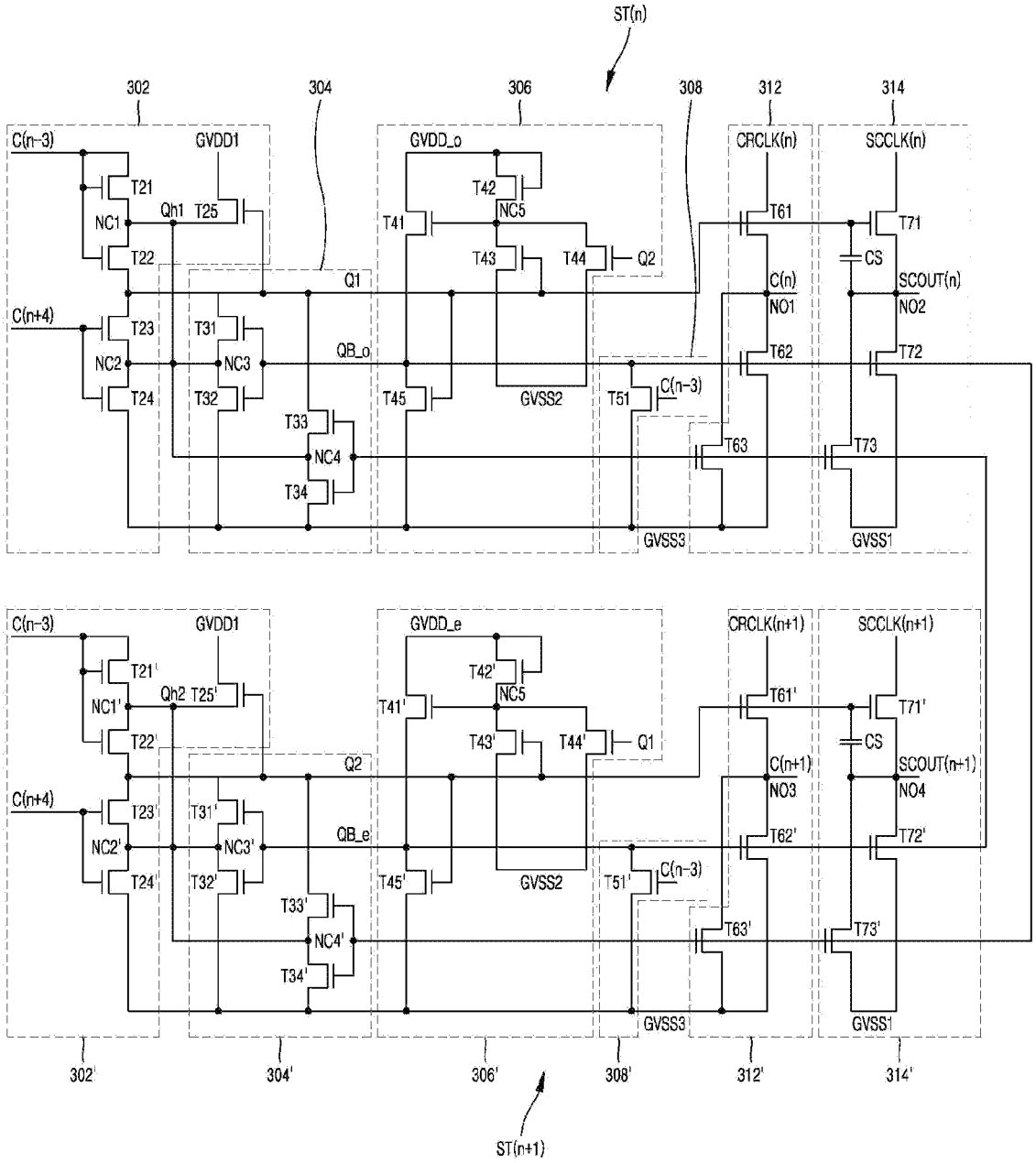
FIG. 5 is a circuit diagram of a stage circuit according to one embodiment of the present disclosure.

FIG. 5 is a circuit diagram of a stage circuit according to one embodiment of the present disclosure.

An n-th stage circuit ST(n) and an (n+1)-th stage circuit ST(n+1) shown in FIG. 5 may be respectively the two stage circuits sharing the QB_o node and the QB_e node with each other among the first to n-th stage circuits ST(1) to ST(n) shown in FIG. 4.

Referring to FIG. 5, the n-th stage circuit ST(n) according to one embodiment of the present disclosure includes a Q1 node, a Qh1 node, and a QB_o node. Further, the n-th stage circuit ST(n) according to one embodiment of the present disclosure includes a Q1 node controller 302, a Q1 node stabilizer 304, an inverter 306, a QB_o node stabilizer 308, a carry signal output module 312, and a gate signal output module 314.

The Q1 node controller 302 charges the Q1 node to a first high-potential voltage GVDD1 level in response to an input of a front carry signal C(n−3), and discharges the Q1 node to a third low-potential voltage GVSS3 level in response to an input of a rear carry signal C(n+4).

The Q1 node controller 302 includes first to fifth transistors T21 to T25. The first transistor T21 and the second transistor T22 are connected to and disposed between a Q1 node and a carry clock signal line for delivering the front carry signal C(n−3). The first transistor T21 and the second transistor T22 are connected in series with each other.

The first transistor T21 and the second transistor T22 charge the Q1 node to a voltage level of the front carry signal C(n−3) in response to an input of the front carry signal C(n−3). The first transistor T21 is turned on based on an input of the front carry signal C(n−3) and thus supplies the first high-potential voltage GVDD1 to a first connection node NC1. The second transistor T22 is turned on based on an input of the front carry signal C(n−3) and thus electrically connects the first connection node NC1 and the Q1 node to each other. Therefore, when the first transistor T21 and the second transistor T22 are simultaneously turned on, the first high-potential voltage GVDD1 is supplied to the Q1 node.

The third transistor T23 and the fourth transistor T24 are connected to and disposed between the Q1 node and a third low-potential voltage line for delivering the third low-potential voltage GVSS3. The third transistor T23 and the fourth transistor T24 are connected in series with each other.

The third transistor T23 and the fourth transistor T24 discharge the Q1 node to the third low-potential voltage GVSS3 level in response to an input of a rear carry signal C(n+4). The third transistor T23 is turned on based on an input of the rear carry signal C(n+4) and thus electrically connects the Q1 node to a second connection node NC2. The fourth transistor T24 is turned on based on an input of the rear carry signal C(n+4) to discharge the second connection node NC2 to the third low-potential voltage GVSS3 level. Therefore, when the third transistor T23 and the fourth transistor T24 are simultaneously turned on, the Q1 node is discharged or reset to the third low-potential voltage GVSS3 level.

The fifth transistor T25 is turned on when a voltage level of the Q1 node becomes a high voltage level. When the fifth transistor T25 is turned on, the first high-potential voltage GVDD1 is transmitted to the Qh1 node and the first connection node NC1.

The Q1 node stabilizer 304 discharges the Q1 node to the third low-potential voltage GVSS3 level in response to a voltage of the QB_o node or the QB_e node.

The Q1 node stabilizer 304 includes a first transistor T31 to a fourth transistor T34.

The first transistor T31 and the second transistor T32 are connected to and disposed between the Q1 node and a third low-potential voltage line for delivering the third low-potential voltage GVSS3. The first transistor T31 and the second transistor T32 are connected in series with each other.

The first transistor T31 and the second transistor T32 discharge the Q1 node to the third low-potential voltage GVSS3 level in response to the voltage of the QB_o node. The first transistor T31 is turned on when the voltage of the QB_o node is at a high voltage level to electrically connect the Q1 node to a third connection node NC3. The second transistor T32 is turned on when the voltage of the QB_o node is at a high voltage level and thus supplies the third low-potential voltage GVSS3 to the third connection node NC3. Therefore, when the first transistor T31 and the second transistor T32 are turned on simultaneously in response to the voltage of the QB_o node, the Q1 node is discharged or reset to the third low-potential voltage GVSS3 level.

The third transistor T33 and the fourth transistor T34 discharge the Q1 node to the third low-potential voltage GVSS3 level in response to the voltage of the QB_e node. The third transistor T33 is turned on when the voltage of the QB_e node is at a high voltage level to electrically connect the Q1 node to the third connection node NC3. The fourth transistor T34 is turned on when the voltage of the QB_e node is at a high voltage level and thus supplies the third low-potential voltage GVSS3 to the third connection node NC3. Therefore, when the third transistor T33 and the fourth transistor T34 are simultaneously turned on in response to the voltage of the QB_e node, the Q1 node is discharged or reset to the third low-potential voltage GVSS3 level.

The inverter 306 changes a voltage level of the QB_o node based on a voltage level of the Q1 node.

The inverter 306 includes first to fifth transistors T41 to T45.

The second transistor T42 and the third transistor T43 are connected to and disposed between an odd-numbered high-potential voltage line for delivering an odd-numbered high-potential voltage GVDD_o and a second low-potential voltage line for delivering a second low-potential voltage GVSS2. The second transistor T42 and the third transistor T43 are connected in series with each other.

The second transistor T42 is turned on based on the odd-numbered high-potential voltage GVDD_o to supply the odd-numbered high-potential voltage GVDD_o to a fifth connection node NC5.

The third transistor T43 supplies the second low-potential voltage GVSS2 to the fifth connection node NC5 in response to a voltage of the Q1 node. The third transistor T43 is turned on when the voltage of the Q1 node is at a high voltage level to discharge or reset the fifth connection node NC5 to the second low-potential voltage GVSS2 level.

The fourth transistor T44 supplies the second low-potential voltage GVSS2 to the fifth connection node NC5 in response to a voltage of the Q2 node. The fourth transistor T44 is turned on when the voltage of the Q2 node is at a high voltage level to discharge or reset the fifth connection node NC5 to the second low-potential voltage GVSS2 level.

The first transistor T41 is connected to and disposed between the odd-numbered high-potential voltage line for delivering the odd-numbered high-potential voltage GVDD_o and the QB_o node.

The first transistor T41 supplies the odd-numbered high-potential voltage GVDD_o to the QB_o node in response to a voltage of the fifth connection node NC5. The first transistor T41 is turned on when the voltage of the fifth connection node NC5 is at a high level to charge the QB_o node to the odd-numbered high-potential voltage GVDD_o level.

The fifth transistor T45 is connected to and disposed between the QB_o node and the third low-potential voltage line for delivering the third low-potential voltage GVSS3.

The fifth transistor T45 supplies the third low-potential voltage GVSS3 to the QB_o node in response to a voltage of the Q1 node. The fifth transistor T45 is turned on when the voltage of the Q1 node is at a high voltage level to discharge or reset the QB_o node to the third low-potential voltage GVSS3 level.

The QB_o node stabilizer 308 discharges the QB_o node to the third low-potential voltage GVSS3 level in response to an input of the front carry signal C(n−3), an input of the reset signal, and a charged voltage of the M node.

The QB_o node stabilizer 308 includes a first transistor T51.

The first transistor T51 is connected to and disposed between the QB_o node and the third low-potential voltage line for delivering the third low-potential voltage GVSS3.

The first transistor T51 supplies the third low-potential voltage GVSS3 to the QB_o node in response to an input of the rear carry signal C(n−3). The first transistor T51 is turned on in response to an input of the rear carry signal C(n−3) to discharge or reset the QB_o node to the third low-potential voltage GVSS3 level.

The carry signal output module 312 operates based on the voltage level of the Q1 node or the voltage level of the QB_o node to output a carry signal C(n) based on a voltage level of a carry clock signal CRCLK(n) or the third low-potential voltage GVSS3 level.

The carry signal output module 312 includes a first transistor T61 and a second transistor T62.

The first transistor T61 is connected to and disposed between a clock signal line for delivering the carry clock signal CRCLK(n) and a first output node NO1.

The first transistor T61 operates in response to the voltage of the Q1 node to output a high level voltage carry signal C(n) based on the carry clock signal CRCLK(n) via the first output node NO1. The first transistor T61 is turned on when the voltage of the Q1 node is at a high level and thus supplies the carry clock signal CRCLK(n) at the high level voltage to the first output node NO1. Accordingly, the high level voltage carry signal C(n) is output.

The second transistor T62 operates in response to the voltage of the QB_o node to output a low level voltage carry signal C(n) based on the third low-potential voltage GVSS3 via the first output node NO1. The second transistor T62 is turned on when the voltage of the QB_o node is at high level and thus supplies the third low-potential voltage GVSS3 to the first output node NO1. Accordingly, the low level voltage carry signal C(n) is output.

The gate signal output module 314 operates in response to the voltage level of the Q1 node, the voltage level of the QB_o node, or the voltage level of the QB_e node to output a gate signal SCOUT(n) based on the scan clock signal SCCLK(n) or a first low-potential voltage GVSS1 level.

The gate signal output module 314 includes first to third transistor T71 to T73, and a boosting capacitor CS. In this connection, the first transistor T71 may be referred to as a pull-up transistor, while each of the second transistor T72 and the third transistor T73 may be referred to as a pull-down transistor.

The first transistor T71 is connected to and disposed between the second output node NO2 node and the clock signal line that transmits the scan clock signal SCCLK(n). The boosting capacitor CS is connected to and disposed between a gate and a source of the first transistor T71.

The first transistor T71 operates in response to the voltage of the Q1 node to output a high level voltage gate signal SCOUT(n) based on the scan clock signal SCCLK(n) via a second output node NO2. The first transistor T71 is turned on when the voltage of the Q1 node is at a high level and thus supplies the scan clock signal SCCLK(n) at the high level voltage to the second output node NO2. Accordingly, the gate signal SCOUT(n) at the high level voltage is output.

When the gate signal SCOUT(n) is output, the boosting capacitor CS bootstraps the voltage of the Q1 node to a boosting voltage level higher than the first high-potential voltage GVDD1 level in a synchronization manner with the scan clock signal SCCLK(n) at the high voltage level. When the voltage of the Q1 node is bootstrapped, the high voltage level scan clock signal SCCLK(n) may be output as the gate signal SCOUT(n) quickly and without distortion.

The second transistor T72 operates in response to the voltage of the QB_o node to output a gate signal SCOUT(n) at a low level voltage based on the first low-potential voltage GVSS1 via the second output node NO2. The second transistor T72 is turned on when the voltage of the QB_o node is at a high level and thus supplies the first low-potential voltage GVSS1 to the second output node NO2. Accordingly, the gate signal SCOUT(n) at the low level voltage is output.

The third transistor T73 operates in response to the voltage of the QB_e node to output a low level voltage gate signal SCOUT(n) based on the first low-potential voltage GVSS1 via the second output node NO2. The third transistor T73 is turned on when the voltage of the QB_e node is at a high level and thus supplies the first low-potential voltage GVSS1 to the second output node NO2. Accordingly, the gate signal SCOUT(n) at the low level voltage is output.

Referring back to FIG. 5, the (n+1)-th stage circuit ST(n+1) according to one embodiment of the present disclosure includes a Q2 node, a Qh2 node, and a QB_e node. Further, the (n+1)-th stage circuit ST(n+1) according to one embodiment of the present disclosure includes a Q2 node controller 302', a Q2 node stabilizer 304', an inverter 306', a QB_e node stabilizer 308', a carry signal output module 312', and a gate signal output module 314'.

The Q2 node controller 302' charges the Q2 node to the first high-potential voltage GVDD1 level in response to an input of the front carry signal C(n−3), and discharges the Q2 node to the third low-potential voltage GVSS3 level in response to an input of the rear carry signal C(n+4).

The Q2 node controller 302' includes first to fifth transistors T21' to T25'.

The first transistor T21' and the second transistor T22' are connected to and disposed between the Q2 node and the carry clock signal line for delivering a front carry signal C(n−2). The first transistor T21' and the second transistor T22' are connected in series with each other.

The first transistor T21' and the second transistor T22' charge the Q2 node to a voltage level of the front carry signal C(n−2) in response to an input of the front carry signal C(n−2). The first transistor T21' is turned on based on an input of the front carry signal C(n−2) and thus supplies the first high-potential voltage GVDD1 to a first connection node NC1'. The second transistor T22' is turned on based on an input of the front carry signal C(n−2) and thus electrically connects the first connection node NC1' to the Q2 node. Therefore, when the first transistor T21' and the second transistor T22' are turned on at the same time, the first high-potential voltage GVDD1 is supplied to the Q2 node.

The third transistor T23' and the fourth transistor T24' are connected to and disposed between the Q2 node and the third low-potential voltage line for delivering the third low-potential voltage GVSS3. The third transistor T23' and the fourth transistor T24' are connected in series with each other.

The third transistor T23' and the fourth transistor T24' discharge the Q2 node to the third low-potential voltage GVSS3 level in response to an input of a rear carry signal C(n+5). The third transistor T23' is turned on based on an input of the rear carry signal C(n+5) and thus electrically connects the Q2 node to a second connection node NC2'. The fourth transistor T24' is turned on based on an input of the rear carry signal C(n+5) to discharge the second connection node NC2' to the third low-potential voltage GVSS3 level. Therefore, when the third transistor T23' and the fourth transistor T24' are turned on at the same time, the Q2 node is discharged or reset to the third low-potential voltage GVSS3 level.

The fifth transistor T25' is turned on when a voltage level of the Q2 node is a high voltage level. When the fifth transistor T25' is turned on, the first high-potential voltage GVDD1 is transmitted to the Qh2 node and the first connection node NC1'.

The Q2 node stabilizer 304' discharges the Q2 node to the third low-potential voltage GVSS3 level in response to a voltage of the QB_e node or the QB_o node.

The Q2 node stabilizer 304' includes a first transistor T31' to a fourth transistor T34'.

The first transistor T31' and the second transistor T32' are connected to and disposed between the Q2 node and the third low-potential voltage line for delivering the third low-potential voltage GVSS3. The first transistor T31' and the second transistor T32' are connected in series with each other.

The first transistor T31' and the second transistor T32' discharge the Q2 node to the third low-potential voltage GVSS3 level in response to the voltage of the QB_e node. The first transistor T31' is turned on when the voltage of the QB_e node is at a high voltage level to electrically connect the Q2 node to a third connection node NC3'. The second transistor T32' is turned on when the voltage of the QB_e node is at a high voltage level and thus supplies the third low-potential voltage GVSS3 to the third connection node NC3'. Therefore, when the first transistor T31' and the second transistor T32' are turned on simultaneously in response to the voltage of the QB_e node, the Q2 node is discharged or reset to the third low-potential voltage GVSS3 level.

The third transistor T33' and the fourth transistor T34' discharge the Q2 node to the third low-potential voltage GVSS3 level in response to the voltage of the QB_o node. The third transistor T33' is turned on when the voltage of the QB_o node is at a high voltage level to electrically connect the Q2 node to the third connection node NC3'. The fourth transistor T34' is turned on when the voltage of the QB_o node is at the high voltage level and thus supplies the third low-potential voltage GVSS3 to the third connection node NC3'. Therefore, when the third transistor T33' and the fourth transistor T34' are turned on simultaneously in response to the voltage of the QB_o node, the Q2 node is discharged or reset to the third low-potential voltage GVSS3 level.

The inverter 306' changes a voltage level of the QB_e node based on a voltage level of the Q2 node. The inverter 306' includes first to fifth transistors T41' to T45'.

The second transistor T42' and the third transistor T43' are connected to and disposed between an even-numbered high-potential voltage line for delivering an even-numbered high-potential voltage GVDD_e and the second low-potential voltage line for delivering the second low-potential voltage GVSS2. The second transistor T42' and the third transistor T43' are connected in series with each other.

The second transistor T42' is turned on based on the even-numbered high-potential voltage GVDD_e to supply the even-numbered high-potential voltage GVDD_e to a fifth connection node NC5'. The third transistor T43' supplies the second low-potential voltage GVSS2 to the fifth connection node NC5' in response to a voltage of the Q2 node. The third transistor T43' is turned on when the voltage of the Q2 node is at a high voltage level to discharge or reset the fifth connection node NC5' to the second low-potential voltage GVSS2.

The fourth transistor T44' supplies the second low-potential voltage GVSS2 to the fifth connection node NC5' in response to a voltage of the Q1 node. The fourth transistor T44' is turned on when the voltage of the Q1 node is at a high voltage level to discharge or reset the fifth connection node NC5' to the second low-potential voltage GVSS2.

The first transistor T41' is connected to and disposed between the even-numbered high-potential voltage line for delivering the even-numbered high-potential voltage GVDD_e and the QB_e node.

The first transistor T41' supplies the even-numbered high-potential voltage GVDD_e to the QB_e node in response to a voltage of the fifth connection node NC5'. The first transistor T41' is turned on when the voltage of the fifth connection node NC5' is at a high level to charge the QB_e node to the even-numbered high-potential voltage GVDD_e level.

The fifth transistor T45' is connected to and disposed between the QB_e node and the third low-potential voltage line for delivering the third low-potential voltage GVSS3.

The fifth transistor T45' supplies the third low-potential voltage GVSS3 to the QB_e node in response to a voltage of the Q2 node. The fifth transistor T45' is turned on when the voltage of the Q2 node is at a high voltage level to discharge or reset the QB_e node to the third low-potential voltage GVSS3 level.

The QB_e node stabilizer 308' discharges the QB_e node to the third low-potential voltage GVSS3 level in response to an input of the front carry signal C(n−2), an input of the reset signal, and a charged voltage of the M node.

The QB_e node stabilizer 308' includes a first transistor T51'.

The first transistor T51' is connected to and disposed between the QB_e node and the third low-potential voltage line for delivering the third low-potential voltage GVSS3.

The first transistor T51' supplies the third low-potential voltage GVSS3 to the QB_e node in response to an input of the front carry signal C(n−2). The first transistor T51' is turned on based on an input of the front carry signal C(n−2) to discharge or reset the QB_e node to the third low-potential voltage GVSS3 level.

The carry signal output module 312' operates based on a voltage level of the Q2 node or a voltage level of the QB_e node to outputs a carry signal C(n+1) based on a voltage level of a carry clock signal CRCLK(n+1) or the third low-potential voltage GVSS3 level.

The carry signal output module 312' includes a first transistor T61' and a second transistor T62'.

The first transistor T61' is connected to and disposed between a clock signal line for delivering the carry clock signal CRCLK(n+1) and a third output node NO3.

The first transistor T61' operates in response to a voltage of the Q2 node to output a high level voltage carry signal C(n+1) based on the carry clock signal CRCLK(n+1) via a third output node NO3. The first transistor T61' is turned on when the voltage of the Q2 node is at a high level and thus supplies the carry clock signal CRCLK(n+1) at a high level voltage to the third output node NO3. Accordingly, the high level voltage carry signal C(n+1) is output.

The second transistor T62' operates in response to a voltage of the QB_e node to output a low level voltage carry signal C(n+1) based on the third low-potential voltage GVSS3 via the third output node NO3. The second transistor T62' is turned on when the voltage of the QB_e node is at a high level and thus supplies the third low-potential voltage GVSS3 to the third output node NO3. Accordingly, the low level voltage carry signal C(n+1) is output.

The gate signal output module 314' operates based on the voltage level of the Q2 node, the voltage level of the QB_e node or the voltage level of the QB_o node to output a gate signal SCOUT(n+1) based on a scan clock signal SCCLK (n+1) or the first low-potential voltage GVSS1 level.

The gate signal output module 314' includes first to third transistors T71 to T73', and a boosting capacitor CS. In this connection, the first transistor T71' may be referred to as a pull-up transistor, while each of the second transistor T72' and the third transistor T73' may be referred to as a pull-down transistor.

The first transistor T71' is connected to and disposed between the QB node and a clock signal line that transmits the scan clock signal SCCLK(n+1). The boosting capacitor CS is connected to and disposed between a gate and a source of the first transistor T71'.

The first transistor T71' operates in response to a voltage of the Q2 node to output a high level voltage gate signal SCOUT(n+1) based on the scan clock signal SCCLK(n+1) via a fourth output node NO4. The first transistor T71' is turned on when the voltage of the Q2 node is at a high level and thus supplies the scan clock signal SCCLK(n+1) at the high level voltage to the fourth output node NO4. Accordingly, the high level voltage gate signal SCOUT(n+1) is output.

When the gate signal SCOUT(n+1) is output, the boosting capacitor CS bootstraps a voltage of the Q2 node to a boosting voltage level higher than the first high-potential voltage GVDD1 level in a synchronization manner with the scan clock signal SCCLK(n+1) at the high voltage level. When the voltage of the Q2 node is bootstrapped, the high voltage level scan clock signal SCCLK(n+1) may be output as the gate signal SCOUT(n+1) quickly and without distortion.

The second transistor T72' operates in response to a voltage of the QB_e node to output a low level voltage gate signal SCOUT(n+1) based on the first low-potential voltage GVSS1 via the fourth output node NO4. The second transistor T72' is turned on when the voltage of the QB_e node is at a high level and thus supplies the first low-potential voltage GVSS1 to the fourth output node NO4. Accordingly, the gate signal SCOUT(n+1) at the low level voltage is output.

The third transistor T73' operates in response to a voltage of the QB_o node to output a low level voltage gate signal SCOUT(n+1) based on the first low-potential voltage GVSS1 via the fourth output node NO4. The third transistor T73' is turned on when the voltage of the QB_o node is at a high level and thus supplies the first low-potential voltage GVSS1 to the fourth output node NO4. Accordingly, the gate signal SCOUT(n+1) at the low level voltage is output.

In one example, as shown in FIG. 5, the n-th stage circuit ST(n) and the (n+1)-th stage circuit ST(n+1) share the QB_o node and the QB_e node with each other.

Figure 6:
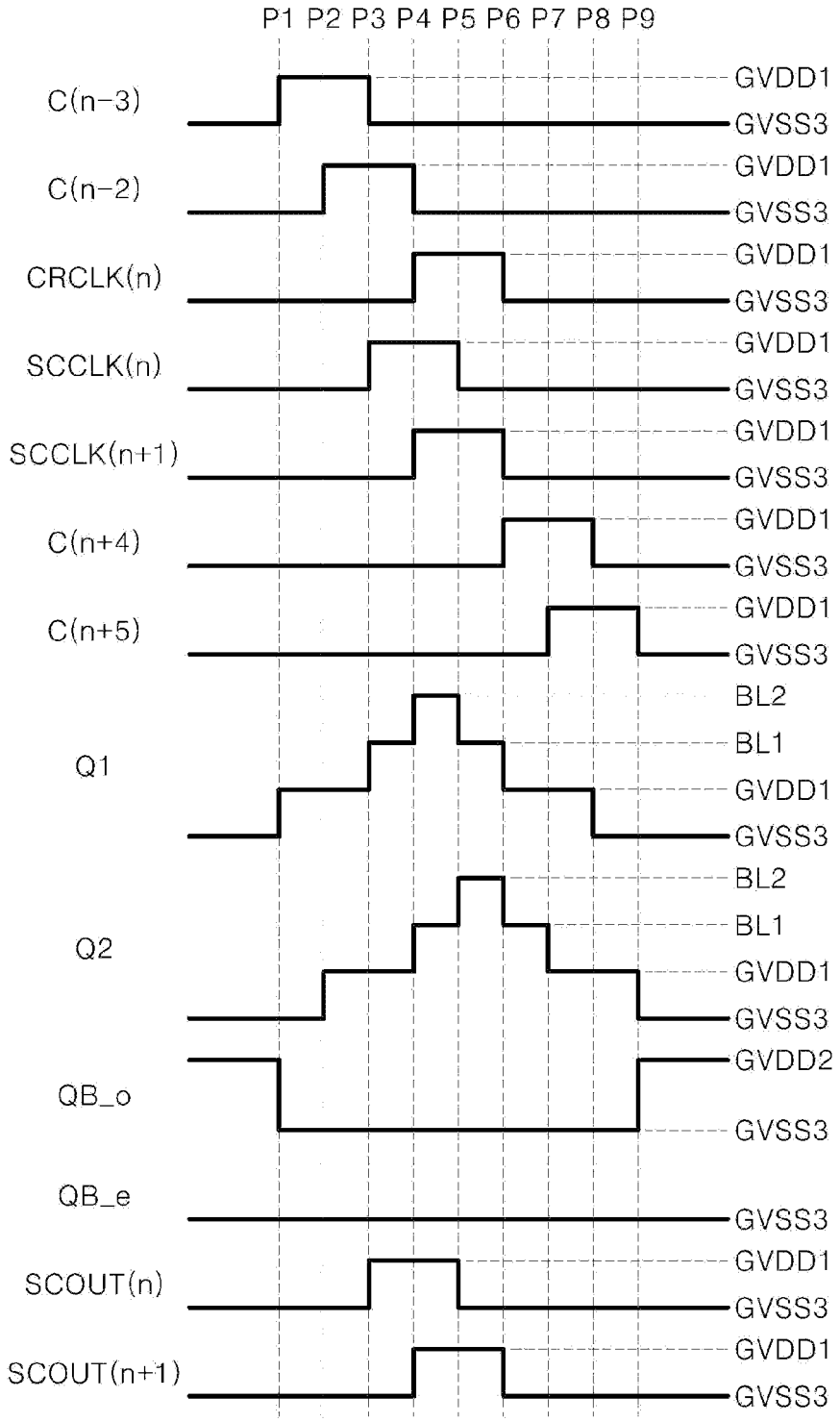
FIG. 6 shows a waveform of each of an input signal and an output signal when the stage circuit of FIG. 5 outputs a gate signal for image display in an odd frame according to one embodiment of the present disclosure.

FIG. 6 shows a waveform of each of an input signal and an output signal when the stage circuit of FIG. 5 outputs a gate signal for image display in an odd-numbered frame. FIG. 6 shows a waveform of each of an input signal and an output signal when the stage circuit of FIG. 5 outputs a gate signal for image display in an even-numbered frame.

The n-th stage circuit ST(n) and the (n+1)-th stage circuit ST(n+1) shown in FIG. 5 may sequentially and respectively the gate signal SCOUT(n) and the gate signal SCOUT(n+1) in the odd-numbered frame and in the even-numbered frame, respectively.

First, referring to FIG. 6, when a high level front carry signal C(n−3) is input for a period P1 to P3 of the odd-numbered frame, the first transistor T21 and the second transistor T22 of the Q1 node controller 302 are turned on. Accordingly, the Q1 node is charged to the first high-potential voltage GVDD1 level. Further, when a high level front carry signal C(n−2) is input for a period P2 to P4 thereof, the first transistor T21' and the second transistor T22' of the Q2 node controller 302' are turned on. Accordingly, the Q2 node is charged to the first high-potential voltage GVDD1 level.

When a high level scan clock signal SCCLK(n) is input for a period P3 to P5, the boosting capacitor CS bootstraps the voltage of the Q1 node to a first boosting voltage BL1 level and a second boosting voltage BL2 level higher than a level of the first high-potential voltage GVDD1. Accordingly, the gate signal SCOUT(n) is output from the second output node NO2 for the period P3 to P5.

Further, when a high level scan clock signal SCCLK(n+1) is input for a period P4 to P6, the boosting capacitor CS bootstraps the voltage of the Q2 node to the first boosting voltage BL1 level and the second boosting voltage BL2 level higher than that of the first high-potential voltage GVDD1. Accordingly, the gate signal SCOUT(n+1) is output from the fourth output node NO4 for the period P4 to P6.

When the scan clock signal is not input and a rear carry signal C(n+4) at a high level is input for a period P6 to P8, a voltage of the Q1 node is charged to the first high-potential voltage GVDD1 level. Further, when the scan clock signal is not input and a rear carry signal C(n+5) at a high level is input for a period P7 to P9, the voltage of the Q2 node is charged to the first high-potential voltage GVDD1 level.

As shown in FIG. 6, when each of the n-th stage circuit ST(n) and the (n+1)-th stage circuit ST(n+1) outputs a gate signal in the odd-numbered frame, the QB_o node may be discharged to the third low-potential voltage GVSS3 level for a period P1 to P9, and may be charged to the second high-potential voltage GVDD2 level for a remaining period. Further, the voltage of the QB_e node is maintained at the third low-potential voltage GVSS3 level for an entire period.

Figure 7:
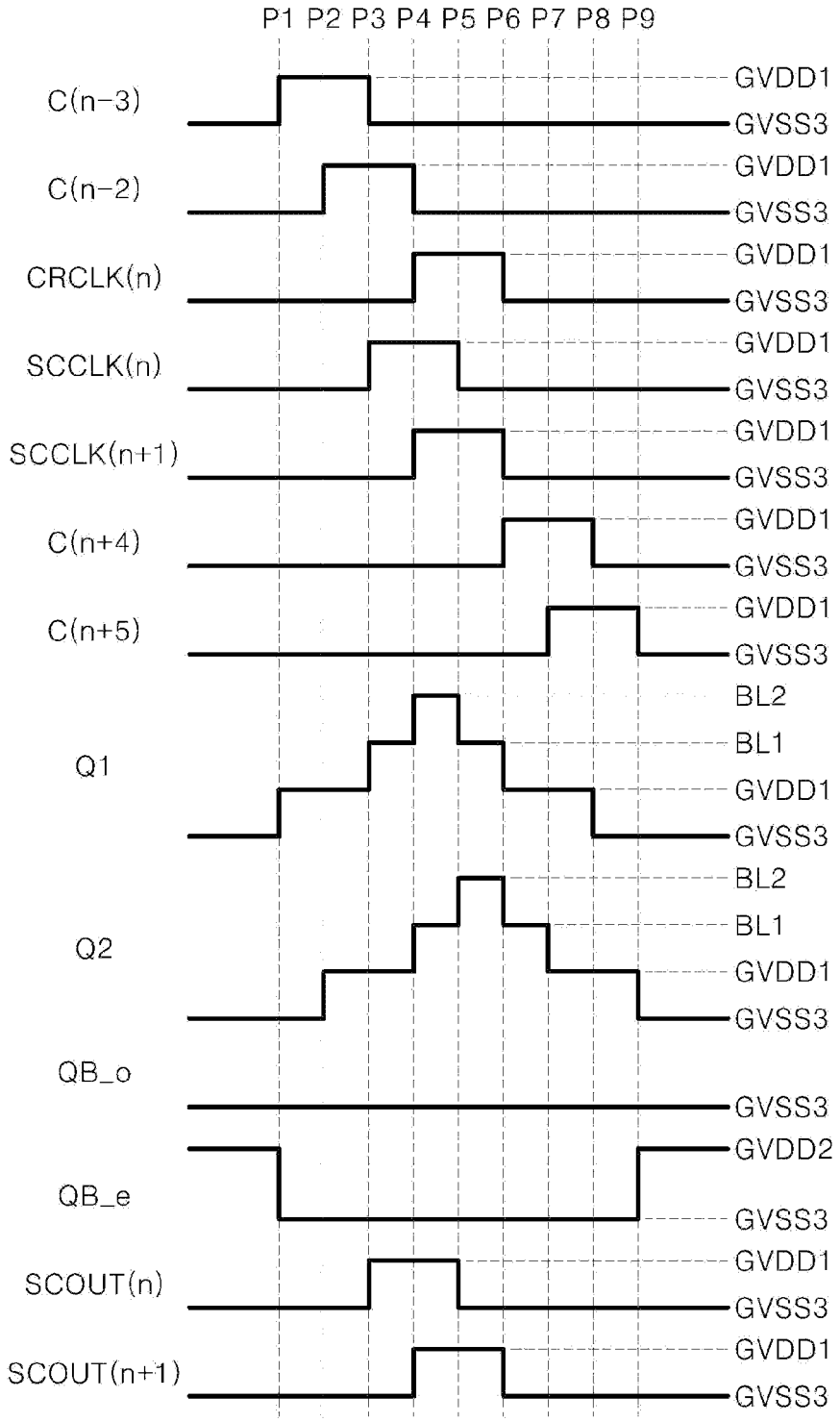
FIG. 7 shows a waveform of each of an input signal and an output signal when the stage circuit of FIG. 5 outputs a gate signal for image display in an even frame according to one embodiment of the present disclosure.

In one example, a gate signal output operation from each of the n-th stage circuit ST(n) and the (n+1)-th stage circuit ST(n+1) in the even-numbered frame shown in FIG. 7 may be performed in a similar manner to that in the odd-numbered frame shown in FIG. 6. However, as shown in FIG. 7, when each of the n-th stage circuit ST(n) and the (n+1)-th stage circuit ST(n+1) outputs the gate signal in the even-numbered frame, the QB_o node may be maintained at the third low-potential voltage GVSS3 level for an entire period. Further, the QB_e node may be discharged to the third low-potential voltage GVSS3 level for a period P1 to P9, and may be charged to the second high-potential voltage GVDD2 level for a remaining period.

In the embodiment shown in FIG. 4 and FIG. 5, the gate driver circuit 13 includes the n gate lines and the n stage circuits corresponding thereto. Further, in the embodiment of FIG. 4 and FIG. 5, the QB_o node and QB_e node of each stage circuit may be alternately charged or discharged in each frame.

Accordingly, the third transistors T63 and T63' respectively included in the carry signal output modules 312 and 312' of each stage circuit may be alternately turned on or off in each frame. Further, the second transistors T72 and T72' and the third transistors T73 and T73' among the pull-down transistors respectively included in the gate signal output modules 314 and 314' of each stage circuit may be alternately turned on or off in each frame. Similarly, the first transistor T31 and the second transistor T32 included in the Q1 node stabilizer 304 may be turned on and off every odd-numbered frame. The first transistor T31' and the second transistor T32' included in the Q2 node stabilizer 304' may be turned on and off every even-numbered frame.

Figure 8:
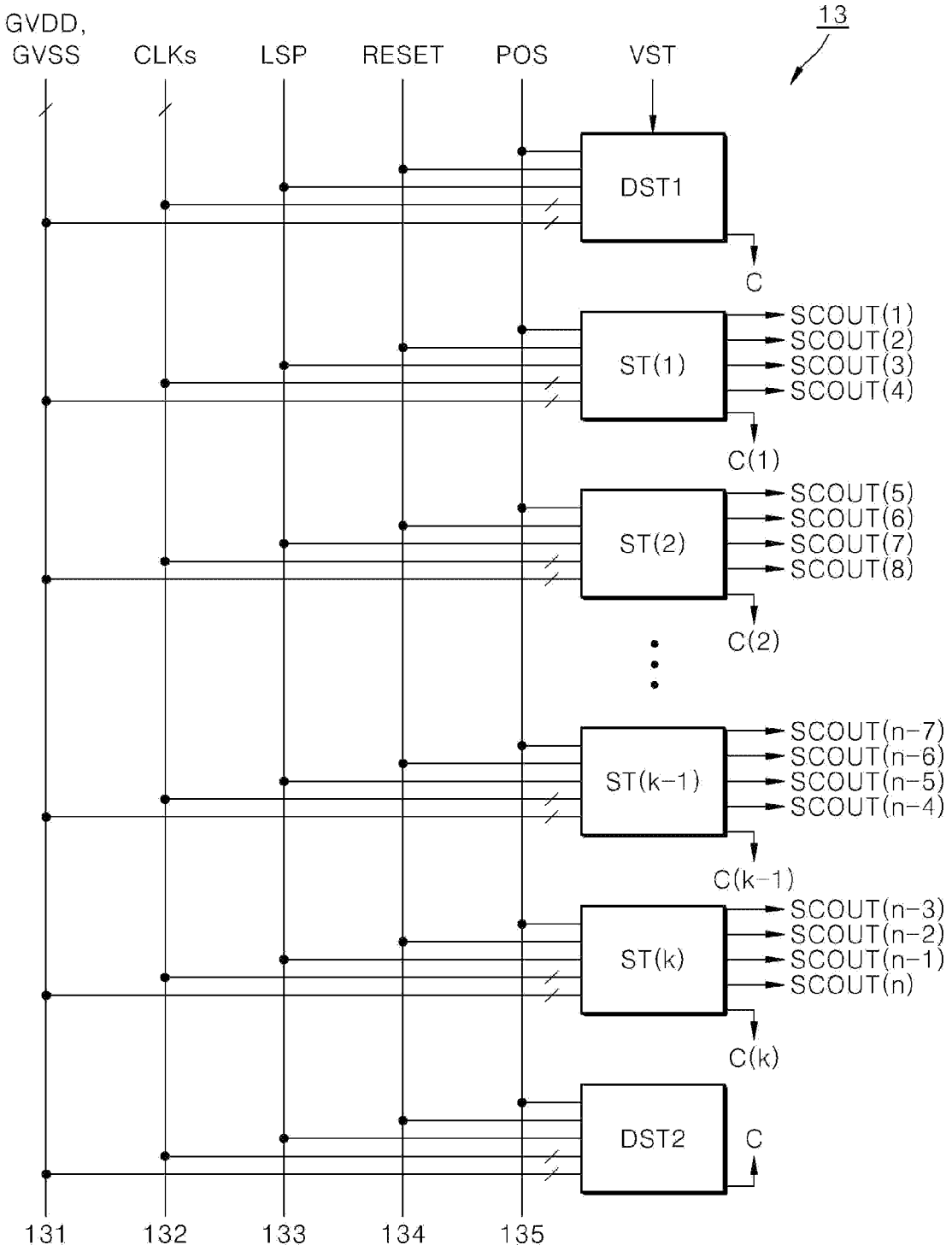
FIG. 8 shows a configuration of a plurality of stage circuits included in a gate driver circuit according to another embodiment of the present disclosure.

FIG. 8 shows a configuration of a plurality of stage circuits included in a gate driver circuit according to another embodiment of the present disclosure.

Referring to FIG. 8, a gate driver circuit 13 according to another embodiment of the present disclosure includes first to k-th stage circuits ST(1) to ST(k) (k is a positive integer), a gate driving voltage line 131, a clock signal line 132, a line sensing preparation signal line 133, and a reset signal line 134, and a panel on signal line 135. Further, the gate driver circuit 13 may further include a front dummy stage circuit DST1 disposed in front of the first stage circuit ST(1) and a rear dummy stage circuit DST2 disposed in rear of the k-th stage circuit ST(k).

The gate driving voltage line 131 may supply a high-potential voltage GVDD and a low-potential voltage GVSS supplied from a power management circuit 16 to each of the first to k-th stage circuits ST(1) to ST(k), the front dummy stage circuit DST1, and the rear dummy stage circuit DST2.

In one embodiment of the present disclosure, the gate driving voltage line 131 may include a plurality of high-potential voltage lines for supplying a plurality of high-potential voltages having different voltage levels, respectively, and a plurality of low-potential voltage lines for supplying a plurality of low-potential voltages having different voltage levels, respectively.

In one example, the gate driving voltage line 131 has three high-potential voltage lines for supplying a first high-potential voltage GVDD1, a second high-potential voltage GVDD2, and a third high-potential voltage GVDD3 having different voltage levels, respectively. The gate driving voltage line 131 has three low-potential voltage lines for supplying a first low-potential voltage GVSS1, a second low-potential voltage GVSS2, and a third low-potential voltage GVSS3 having different voltage levels, respectively. However, this is only one example. The number of the lines included in the gate driving voltage line 131 may vary based on embodiments.

The clock signal line 132 may supply a plurality of clock signals CLKs supplied from the timing controller 11, for example, a carry clock signal CRCLK or a scan clock signal SCCLK to each of the first to k-th stage circuits ST(1) to ST(k), the front dummy stage circuit DST1 and the rear dummy stage circuit DST2.

The line sensing preparation signal line 133 may supply a line sensing preparation signal LSP supplied from the timing controller 11 to the first to k-th stage circuits ST(1) to ST(k). Optionally, the line sensing preparation signal line 133 may be further connected to the front dummy stage circuit DST1.

The reset signal line 134 may supply a reset signal RESET supplied from the timing controller 11 to each of the first to k-th stage circuits ST(1) to ST(k), the front dummy stage circuit DST1, and the rear dummy stage circuit DST2.

The panel on signal line 135 may supply a panel on signal POS supplied from the timing controller 11 to each of the first to k-th stage circuits ST(1) to ST(k), the front dummy stage circuit DST1, and the rear dummy stage circuit DST2.

Although not shown, lines for supplying signals other than the lines 131, 132, 133, 134, and 135 as shown in FIG. 8 may be additionally connected to the first to k-th stage circuits ST(1) to ST(k), the front dummy stage circuit DST1, and the rear dummy stage circuit DST2. In one example, a line for supplying a gate start signal VST to the front dummy stage circuit DST1 may be additionally connected to the front dummy stage circuit DST1.

The front dummy stage circuit DST1 outputs a front carry signal C in response to an input of the gate start signal VST supplied from the timing controller 11. The front carry signal C may be supplied to one of the first to k-th stage circuits ST(1) to ST(k).

The rear dummy stage circuit DST2 outputs a rear carry signal C. The rear carry signal C may be supplied to one of the first to k-th stage circuits ST(1) to ST(k).

The first to k-th stage circuits ST(1) to ST(k) may be connected to each other in a cascaded manner or in a stepped manner.

In one embodiment of the present disclosure, each of the first to k-th stage circuits ST(1) to ST(k) outputs j (j is a positive integer) gate signals SCOUT and one carry signal C. That is, each stage circuit outputs first to j-th gate signals and one carry signal C.

For example, in an embodiment shown in FIG. 8, each stage circuit outputs four gate signals SCOUT and one carry signal C. For example, the first stage circuit ST(1) outputs a first gate signal SCOUT(1), a second gate signal SCOUT(2), a third gate signal SCOUT(3), a fourth gate signal SCOUT (4) and a first carry signal C(1). The second stage circuit ST 2 outputs a fifth gate signal SCOUT(5), a sixth gate signal SCOUT(6), a seventh gate signal SCOUT(7), an eighth gate signal SCOUT(8), and a second carry signal C(2). Therefore, in FIG. 8, j is 4.

The total number of the gate signals output from the first to k-th stage circuits ST(1) to ST(k) is equal to the number n of the gate lines 15 arranged on the display panel 10. As described above, each stage circuit outputs the j gate signals. Therefore, j×k=n is established.

For example, in the embodiment shown in FIG. 8 in which j=4, the number k of the stage circuits is equal to ¼ of the number n of the gate lines 15. That is, in the embodiment of FIG. 8, k=n/4.

However, the number of the gate signals output from each stage circuit is not limited thereto. That is, in another embodiment of the present disclosure, each stage circuit may output one, two, or threes gate signals, or may output five or more gate signals. The number of the stage circuits may vary according to the number of the gate signals output from each stage circuit.

Hereinafter, an embodiment in which each stage circuit outputs four gate signals SCOUT and one carry signal C will be described. However, the present disclosure is not limited to this embodiment.

Each of the gate signals SCOUT output from the first to k-th stage circuits ST(1) to ST(k) may act as the gate signal for sensing the threshold voltage or the gate signal for displaying the image. Further, each carry signal C output from each of the first to k-th stage circuits ST(1) to ST(k) may be supplied to a stage circuit other than each stage circuit. In accordance with the present disclosure, a carry signal which one stage circuit receives from the front stage circuit may be referred to as the front carry signal, while a carry signal which one stage circuit receives from the rear stage circuit may be referred to as the rear carry signal.

Figure 9:
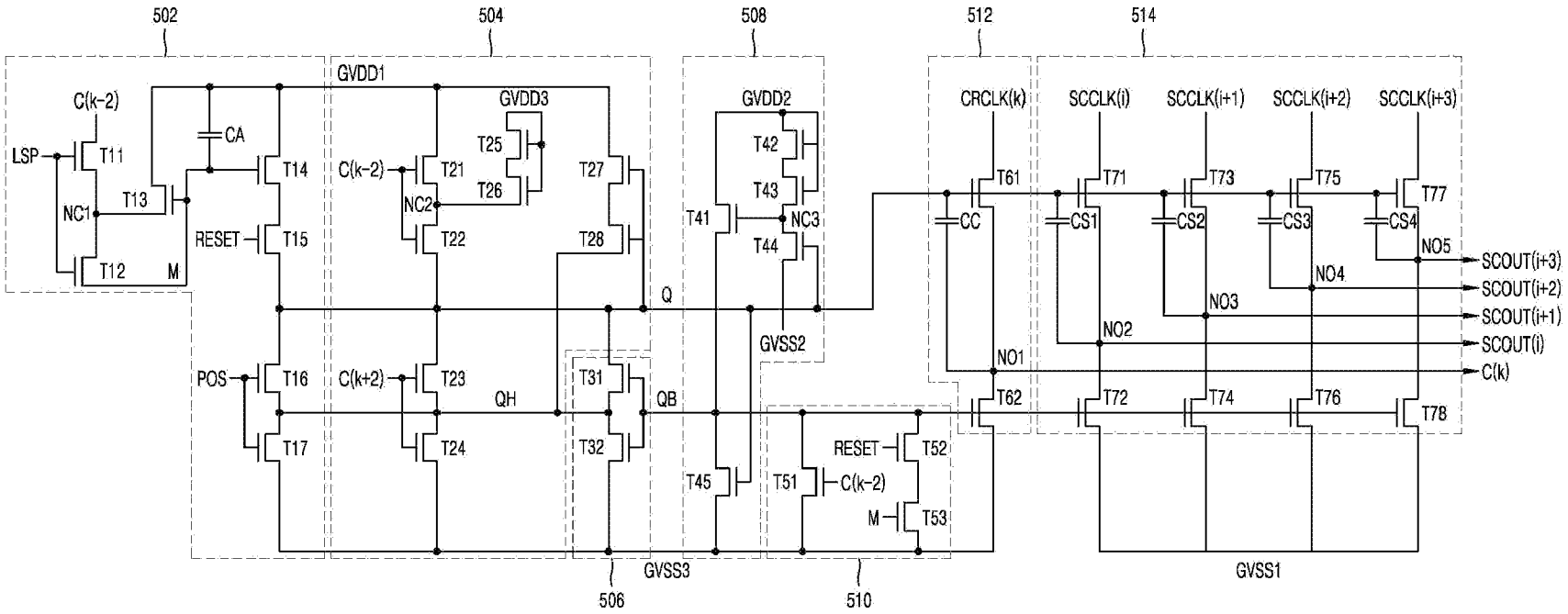
FIG. 9 is a circuit diagram of a stage circuit according to another embodiment of the present disclosure.

FIG. 9 is a circuit diagram of a stage circuit according to another embodiment of the present disclosure.

The stage circuit shown in FIG. 9 may be one stage circuit among the first to k-th stage circuits ST(1) to ST(k) shown in FIG. 8.

Referring to FIG. 9, the stage circuit according to one embodiment of the present disclosure includes an M node, a Q node, and a QB node. Further, the stage circuit according to one embodiment of the present disclosure includes a line selector 502, a Q node controller 504, a Q node and QH node stabilizer 506, an inverter 508, a QB node stabilizer 510, a carry signal output module 512, and a gate signal output module 514.

The line selector 502 charges the M node based on the front carry signal C(k−2) in response to an input of the line sensing preparation signal LSP. Further, the line selector 502 charges the Q node to a first high-potential voltage GVDD1 level based on a charged voltage of the M node in response to an input of the reset signal RESET. Further, the line selector 502 discharges or resets the Q node to a third low-potential voltage GVSS3 level in response to an input of the panel on signal POS.

The line selector 502 includes first to seventh transistors T11 to T17 and a pre-charging capacitor CA.

The first transistor T11 and the second transistor T12 are connected to and disposed between a first high-potential voltage line for delivering the first high-potential voltage GVDD1 and the M node. Further, the first transistor T11 and the second transistor T12 are connected in series with each other.

The first transistor T11 outputs a front carry signal C(k−2) to a first connection node NC1 in response to an input of the line sensing preparation signal LSP. The second transistor T12 electrically connects the first connection node NC1 to the M node in response to an input of the line sensing preparation signal LSP. For example, when the line sensing preparation signal LSP of a high level voltage is input to the first transistor T11 and the second transistor T12, the first transistor T11 and the second transistor T12 are simultaneously turned on to charge the M node to the first high-potential voltage GVDD1 level.

A third transistor T13 may be turned on when a voltage level of the M node is at a high level, and thus may supply the first high-potential voltage GVDD1 to the first connection node NC1. When the first high-potential voltage GVDD1 is supplied to the first connection node NC1, a difference between a gate voltage of the first transistor T11 and a voltage of the first connection node NC1 increases. Therefore, when the line sensing preparation signal LSP of a low level voltage is input to a gate of the first transistor T11 such that the first transistor T11 is turned off, the first transistor T11 may be maintained in a completely turned off state due to the difference between the gate voltage of the first transistor T11 and the voltage of the first connection node NC1. Accordingly, current leakage of the first transistor T11 and thus, voltage drop of the M node may be prevented, so that the voltage of the M node may be stably maintained.

The pre-charging capacitor CA is connected to and disposed between the first high-potential voltage line for delivering the first high-potential voltage GVDD1 and the M node, and stores therein a voltage corresponding to a difference between the first high-potential voltage GVDD1 and a voltage charged to the M node. When the first transistor T11, the second transistor T12, and the third transistor T13 are turned on, the pre-charging capacitor CA stores therein a high level voltage of the front carry signal C(k−2). When the first transistor T11, the second transistor T12, and the third transistor T13 are turned off, the pre-charging capacitor CA maintains the voltage of the M node using the voltage stored therein for a certain period of time.

A fourth transistor T14 and a fifth transistor T15 are connected to and disposed between the Q node and the first high-potential voltage line for delivering the first high-potential voltage GVDD1. The fourth transistor T14 and the fifth transistor T15 are connected in series with each other.

The fourth transistor T14 and the fifth transistor T15 charge the Q node to the first high-potential voltage GVDD1 in response to the voltage of the M node and an input of the reset signal RESET. The fourth transistor T14 may be turned on when the voltage of the M node is at a high level, and thus may transmit the first high-potential voltage GVDD1 to a shared node between the fourth transistor T14 and the fifth transistor T15. The fifth transistor T15 may be turned on based on a high level reset signal RESET to supply the voltage of the shared node to the Q node. Therefore, when the fourth transistor T14 and the fifth transistor T15 are simultaneously turned on, the Q node is charged with the first high-potential voltage GVDD1.

A sixth transistor T16 and a seventh transistor T17 are connected to and disposed between the Q node and a third low-potential voltage line that may transmit the third low-potential voltage GVSS3. The sixth transistor T16 and the seventh transistor T17 are connected in series to each other.

The sixth transistor T16 and the seventh transistor T17 discharge the Q node to the third low-potential voltage GVSS3 in response to an input of the panel on signal POS. The Q node being discharged to the third low-potential voltage GVSS3 may also be referred to as the Q node being reset. The seventh transistor T17 may be turned on based on an input of a high level panel on signal POS to supply the third low-potential voltage GVSS3 to the QH node. The sixth transistor T16 is turned on according to an input of the high level panel-on signal POS to electrically connect the Q node and the QH node to each other. Therefore, when the sixth transistor T16 and the seventh transistor T17 are simultaneously turned on, the Q node is discharged or reset to the third low-potential voltage GVSS3.

The Q node controller 504 charges the Q node to the first high-potential voltage GVDD1 level, in response to an input of the front carry signal C(k−2), and discharges the Q node to the third low-potential voltage GVSS3 level, in response to an input of the rear carry signal C(k+2).

The Q node controller 504 includes first to eighth transistors T21 to T28.

The first transistor T21 and the second transistor T22 are connected to and disposed between the Q node and the first high-potential voltage line for delivering the first high-potential voltage GVDD1. The first transistor T21 and the second transistor T22 are connected in series with each other.

The first transistor T21 and the second transistor T22 charge the Q node to the first high-potential voltage GVDD1 level in response to an input of the front carry signal C(k−2). The first transistor T21 may be turned on according to an input of the front carry signal C(k−2) and thus may supply the first high-potential voltage GVDD1 to the second connection node NC2. The second transistor T22 may be turned on according to an input of the front carry signal C(k−2) and may electrically connect the second connection node NC2 and the Q node to each other. Therefore, when the first transistor T21 and the second transistor T22 are simultaneously turned on, the first high-potential voltage GVDD1 is supplied to the Q node.

A fifth transistor T25 and a sixth transistor T26 are connected to the third high-potential voltage line for delivering the third high-potential voltage GVDD3. The fifth transistor T25 and the sixth transistor T26 supply the third high-potential voltage GVDD3 to a second connection node NC2 in response to the third high-potential voltage GVDD3.

The fifth transistor T25 and the sixth transistor T26 are turned on at the same time based on the third high-potential voltage GVDD3, such that the third high-potential voltage GVDD3 is constantly supplied to the second connection node NC2, thereby increasing a difference between the gate voltage of the first transistor T21 and a voltage of the second connection node NC2. Therefore, when a low level front carry signal C(k−2) is input to the gate of the first transistor T21 and thus, the first transistor T21 is turned off, the first transistor T21 may be maintained in a completely turned-off state due to the difference between the gate voltage of the first transistor T21 and the voltage of the second connection node NC2. Accordingly, the current leakage of the first transistor T21 and thus, the voltage drop of the Q node may be prevented, so that the voltage of the Q node may be stably maintained.

In one example, when a threshold voltage of the first transistor T21 is negative (−), the gate-source voltage Vgs of the first transistor T21 is maintained to be negative (−) due to the third high-potential voltage GVDD3 supplied to the drain electrode. Therefore, when the low level front carry signal C(k−2) is input to the gate of the first transistor T21 and thus the first transistor T21 is turned off, the first transistor T21 may be maintained in a completely turned off state to prevent the leakage current therefrom.

In one embodiment of the present disclosure, the third high-potential voltage GVDD3 is set to a lower voltage level than that of the first high-potential voltage GVDD1.

A third transistor T23 and a fourth transistor T24 are connected to and disposed between the Q node and the third low-potential voltage line for delivering the third low-potential voltage GVSS3. The third transistor T23 and the fourth transistor T24 are connected in series with each other.

The third transistor T23 and the fourth transistor T24 discharge the Q node and the QH node to the third low-potential voltage GVSS3 level in response to an input of the rear carry signal C(k+2). The fourth transistor T24 is turned on according to an input of the rear carry signal C(k+2) to discharge the QH node to the third low-potential voltage GVSS3 level. The third transistor T23 is turned on according to an input of the rear carry signal C(k+2) to electrically connect the Q node and the QH node to each other. Therefore, when the third transistor T23 and the fourth transistor T24 are simultaneously turned on, each of the Q node and the QH node is discharged or reset to the third low-potential voltage GVSS3 level.

A seventh transistor T27 and an eighth transistor T28 are connected to and disposed between the first high-potential voltage line for delivering the first high-potential voltage GVDD1 and the Q node, and are connected to and disposed between the first high-potential voltage line for delivering the first high-potential voltage GVDD1 and the QH node. The seventh transistor T27 and the eighth transistor T28 are connected in series with each other.

The seventh transistor T27 and the eighth transistor T28 supply the first high-potential voltage GVDD1 to the QH node in response to the voltage of the Q node. The seventh transistor T27 may be turned on when the voltage of the Q node is at a high level and thus may supply the first high-potential voltage GVDD1 to a shared node between the seventh transistor T27 and the eighth transistor T28. The eighth transistor T28 may be turned on when the voltage of the Q node is at a high level and thus may electrically connect the shared node and the QH node to each other. Therefore, the seventh transistor T27 and the eighth transistor T28 are simultaneously turned on when the voltage of the Q node is at a high level, such that the first high-potential voltage GVDD1 is supplied to the QH node.

When the first high-potential voltage GVDD1 is supplied to the QH node, a difference between the gate voltage of the third transistor T23 and the voltage of the QH node increases. Therefore, when the low level rear carry signal C(k+2) is input to the gate of the third transistor T23 and thus the third transistor T23 is turned off, the third transistor T23 may be maintained in a completely turned off state due to the difference between the gate voltage of the third transistor T23 and the voltage of the QH node. Accordingly, current leakage of the third transistor T23 and thus, the voltage drop of the Q node may be prevented, so that the voltage of the Q node may be stably maintained.

The Q node and QH node stabilizer 506 discharges the Q node and the QH node to the third low-potential voltage GVSS3 level in response to the voltage of the QB node.

The Q node and QH node stabilizer 506 includes a first transistor T31 and a second transistor T32. The first transistor T31 and the second transistor T32 are connected to and disposed between the Q node and the third low-potential voltage line for delivering the third low-potential voltage GVSS3. The first transistor T31 and the second transistor T32 are connected in series with each other.

The first transistor T31 and the second transistor T32 discharge the Q node and the QH node to the third low-potential voltage GVSS3 level in response to the voltage of the QB node. The second transistor T32 may be turned on when the voltage of the QB node is at a high level and thus may supply the third low-potential voltage GVSS3 to a shared node between the first transistor T31 and the second transistor T32. The first transistor T31 may be turned on when the voltage of the QB node is at a high level and thus may electrically connect the Q node and the QH node to each other. Therefore, when the first transistor T31 and the second transistor T32 are turned on simultaneously in response to the voltage of the QB node, each of the Q node and the QH node may be discharged or reset to the third low-potential voltage GVSS3 level.

The inverter 508 changes a voltage level of the QB node according to a voltage level of the Q node.

The inverter 508 includes first to fifth transistors T41 to T45.

A second transistor T42 and a third transistor T43 are connected to and disposed between a second high-potential voltage line for delivering the second high-potential voltage GVDD2 and a third connection node NC3. The second transistor T42 and the third transistor T43 are connected in series with each other.

The second transistor T42 and the third transistor T43 supply the second high-potential voltage GVDD2 to the third connection node NC3 in response to the second high-potential voltage GVDD2. The second transistor T42 is turned on based on the second high-potential voltage GVDD2 to supply the second high-potential voltage GVDD2 to a shared node between the second transistor T42 and the third transistor T43. The third transistor T43 is turned on based on the second high-potential voltage GVDD2 to electrically connect the shared node between the second transistor T42 and the third transistor T43 to the third connection node NC3. Therefore, when the second transistor T42 and the third transistor T43 are simultaneously turned on based on the second high-potential voltage GVDD2, the third connection node NC3 is charged to the second high-potential voltage GVDD2 level.

The fourth transistor T44 is connected to and disposed between the third connection node NC3 and the second low-potential voltage line for delivering the second low-potential voltage GVSS2.

The fourth transistor T44 may supply the second low-potential voltage GVSS2 to the third connection node NC3 in response to a voltage of the Q node. The fourth transistor T44 may be turned on when the voltage of the Q node is at a high level and thus may discharge or reset the third connection node NC3 to the second low-potential voltage GVSS2.

The first transistor T41 is connected to and disposed between the second high-potential voltage line for delivering the second high-potential voltage GVDD2 and the QB node.

The first transistor T41 may supply the second high-potential voltage GVDD2 to the QB node in response to a voltage of the third connection node NC3.

The first transistor T41 may be turned on when the voltage of the third connection node NC3 is at a high level and thus may charge the QB node to the second high-potential voltage GVDD2 level.

The fifth transistor T45 is connected to and disposed between the QB node and the third low-potential voltage line for delivering the third low-potential voltage GVSS3.

The fifth transistor T45 may supply the third low-potential voltage GVSS3 to the QB node in response to a voltage of the Q node. The fifth transistor T45 may be turned on when the voltage of the Q node is at a high level and thus may discharge or reset the QB node to the third low-potential voltage GVSS3 level.

The QB node stabilizer 510 discharges the QB node to the third low-potential voltage GVSS3 level in response to an input of the rear carry signal C(k−2), to an input of the reset signal, and to a charged voltage of the M node.

The QB node stabilizer 510 includes first to third transistor T51 to T53.

The first transistor T51 is connected to and disposed between the QB node and the second low-potential voltage line for delivering the third low-potential voltage GVSS3.

The first transistor T51 may supply a third low-potential voltage GVSS3 to the QB node in response to an input of the rear carry signal C(k−2). The fifth transistor T45 may be turned on when the voltage of the Q node is at a high level and thus may discharge or reset the QB node to the third low-potential voltage GVSS3 level.

The second transistor T52 and the third transistor T53 are connected to and disposed between the QB node and the third low-potential voltage line for delivering the third low-potential voltage GVSS3. The second transistor T52 and the third transistor T53 are connected in series with each other.

The second transistor T52 and the third transistor T53 discharge the QB node to the third low-potential voltage GVSS3 level in response to an input of the reset signal and a charged voltage of the M node. The third transistor T53 may be turned on when the voltage of the M node is at a high level and thus may supply the third low-potential voltage GVSS3 to a shared node between the second transistor T52 and the third transistor T53. The second transistor T52 may be turned on based on an input of the reset signal RESET, such that the shared node between the second transistor T52 and the third transistor T53 is electrically connected to the QB node. Therefore, when the reset signal RESET is input to the second transistor T52 and the third transistor T53 while the voltage of the M node is at a high level, the second transistor T52 and the third transistor T53 are turned on at the same time to discharge or reset the QB node to the third low-potential voltage GVSS2 level.

The carry signal output module 512 outputs the carry signal C(k) based on a voltage level of the carry clock signal CRCLK(k) or the third low-potential voltage GVSS3 level, according to a voltage level of the Q node or a voltage level of the QB node.

The carry signal output module 512 includes a first transistor T61, a second transistor T62, and a boosting capacitor CC.

The first transistor T61 is connected to and disposed between a clock signal line for delivering the carry clock signal CRCLK(k) and a first output node NO1. The boosting capacitor CC is connected to and disposed between a gate and a source of the first transistor T61.

The first transistor T61 outputs a high level voltage carry signal C(k) through the first output node NO1, based on the carry clock signal CRCLK(k), in response to a voltage of the Q node. The first transistor T61 may be turned on when the voltage of the Q node is at a high level and thus may supply the carry clock signal CRCLK(k) of a high level voltage to the first output node NO1. Accordingly, the high level voltage carry signal C(k) is output.

When the carry signal C(k) is output, the boosting capacitor CC bootstraps a voltage of the Q node to a boosting voltage level higher than the first high-potential voltage GVDD1 level while being in synchronization with the carry clock signal CRCLK(k) of the high level voltage level. When the voltage of the Q node is bootstrapped, the high voltage level carry clock signal CRCLK(k) may be output as the carry signal C(k) quickly and without distortion.

The second transistor T62 is connected to and disposed between the first output node NO1 and the third low-potential voltage line for delivering the third low-potential voltage GVSS3.

The second transistor T62 outputs a low level voltage carry signal C(k) through the first output node NO1, based on the third low-potential voltage GVSS3, in response to a voltage of the QB node. The second transistor T62 may be turned on when the voltage of the QB node is at a high level and thus may supply the third low-potential voltage GVSS3 to the first output node NO1. Accordingly, the low level voltage carry signal C(k) is output.

The gate signal output module 514 may output a plurality of the gate signals SCOUT(i), SCOUT(i+1), SCOUT(i+2), and SCOUT(i+3), based on voltage levels of a plurality of scan clock signals SCCLK(i), SCCLK(i+1), SCCLK(i+2), and SCCLK(i+3), or the first low-potential voltage GVSS1 level, according to a voltage level of the Q node or a voltage level of the QB node. In this connection, i is a positive integer.

The gate signal output module 514 includes first to eighth transistors T71 to T78, and boosting capacitors CS1, CS2, CS3, and CS4.

A first transistor T71, a third transistor T73, a fifth transistor T75, and a seventh transistor T77 are respectively connected to and disposed between clock signal lines for respectively delivering scan clock signals SCCLK(i), SCCLK(i+1), SCCLK(i+2) and SCCLK(i+3) and the second to fifth output nodes NO2 to NO5. Each of the boosting capacitors CS1, CS2, CS3, and CS4 is connected to and disposed between a gate and a source of each of the first transistor T71, the third transistor T73, the fifth transistor T75, and the seventh transistor T77.

Each of the first transistor T71, the third transistor T73, the fifth transistor T75, and the seventh transistor T77 outputs each of high level voltage gate signals SCOUT(i), SCOUT(i+1), SCOUT(i+2), and SCOUT(i+3) via each of a second output node NO2, a third output node NO3, a fourth output node NO4, and a fifth output node NO5, based on each of the scan clock signals SCCLK(i), SCCLK(i+1), SCCLK(i+2), and SCCLK(i+3), and in response to a voltage of the Q node. Each of the first transistor T71, the third transistor T73, the fifth transistor T75, and the seventh transistor T77 is turned on when the voltage of the Q node is at a high level and thus may supply each of the high level voltage scan clock signals SCCLK(i), SCCLK(i+1), SCCLK(i+2), and SCCLK(i+3) to each of the second output node NO2, the third output node NO3, the fourth output node NO4, and the fifth output node NO5. Accordingly, the high level voltage gate signals SCOUT(i), SCOUT(i+1), SCOUT(i+2), and SCOUT(i+3) are respectively output.

When the gate signals SCOUT(i), SCOUT(i+1), SCOUT(i+2), SCOUT(i+3) are respectively output, the boosting capacitors CS1, CS2, CS3, and CS4 bootstrap or increase the voltage of the Q node to a boosting voltage level higher than the first high-potential voltage GVDD1 level, while being respectively synchronized with the high level voltage scan clock signals SCCLK(i), SCCLK(i+1), SCCLK(i+2), and SCCLK(i+3). When the voltage of the Q node is bootstrapped, the high voltage level scan clock signals SCCLK(i), SCCLK(i+1), SCCLK(i+2), and SCCLK(i+3) may be respectively output as the gate signals SCOUT(i), SCOUT(i+1), SCOUT(i+2), and SCOUT(i+3) quickly and without distortion.

A second transistor T72, a fourth transistor T74, a sixth transistor T76, and an eighth transistor T78 respectively output low level voltage gate signals SCOUT(i), SCOUT(i+1), SCOUT(i+2), and SCOUT(i+3) respectively via the second output node NO2, the third output node NO3, the fourth output node NO4, and the fifth output node NO5, based on the first low-potential voltage GVSS1 and in response to a voltage of the QB node. The second transistor T72, the fourth transistor T74, the sixth transistor T76, and the eighth transistor T78 may be respectively turned on when the voltage of the QB node is at a high level and thus may supply the first low-potential voltage GVSS1 to the second output node NO2, the third output node NO3, the fourth output node NO4, and the fifth output node NO5, respectively. Accordingly, the low level voltage gate signals SCOUT(i), SCOUT(i+1), SCOUT(i+2), and SCOUT(i+3) are respectively output.

In the embodiment shown in FIG. 9, each stage circuit may receive the three high-potential voltages GVDD1, GVDD2, and GVDD3 set to different levels, and the three low-potential voltages GVSS1, GVSS2, and GVSS3 set to different levels. For example, the first high-potential voltage GVDD1 may be set to 20V, the second high-potential voltage GVDD2 may be set to 16V, and the third high-potential voltage GVDD3 may be set to 14V. The first low-potential voltage GVSS1 may be set to −6V, the second low-potential voltage GVSS2 may be set to −10V, and the third low-potential voltage GVSS3 may be set to −12V. These numerical values are just one example. The levels of the high-potential voltages and the low-potential voltage may vary based on embodiments.

Figure 10:
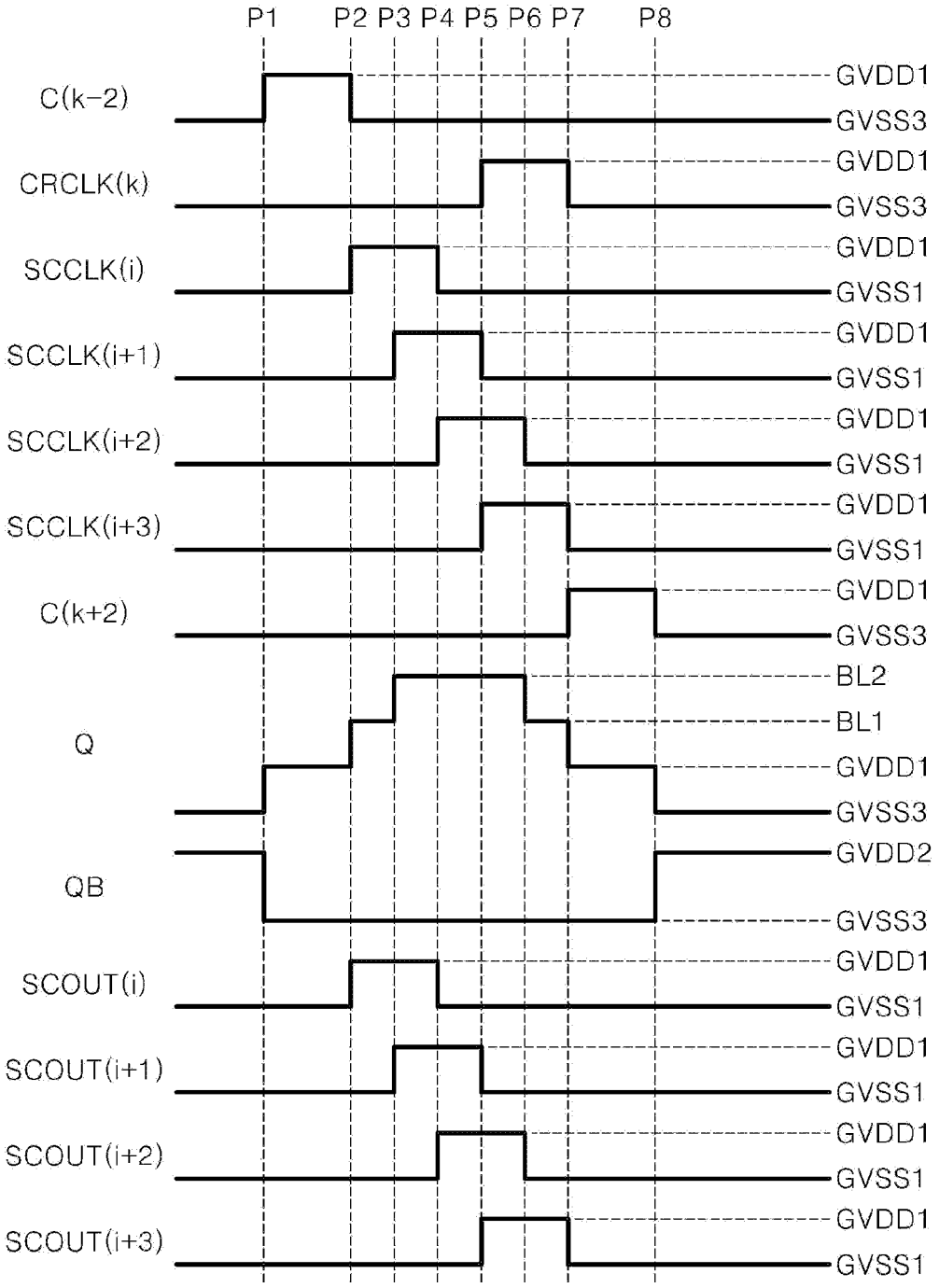
FIG. 10 shows a waveform of each of an input signal and an output signal when the stage circuit of FIG. 9 outputs a gate signal for image display according to the other embodiment of the present disclosure.

FIG. 10 shows a waveform of each of an input signal and an output signal when the stage circuit of FIG. 9 outputs a gate signal for image display.

When a high level front carry signal C(k−2) is input for a period P1 to P2, the first transistor T21 and the second transistor T22 of the Q node controller 504 are turned on. Accordingly, the Q node has been charged to the first high-potential voltage GVDD1 level. Further, the first transistor T51 of the QB node stabilizer 510 is turned on based on a high level front carry signal C(k−2), and thus the QB node has been discharged to the third low-potential voltage GVSS3 level.

When a high level scan clock signal SCCLK(i) is input for a period P2 to P3, the boosting capacitor CS1 may bootstrap a voltage of the Q node to a first boosting voltage BL1 level higher than that of the first high-potential voltage GVDD1. Accordingly, the gate signal SCOUT(i) is output from second output node NO2 for a period P2 to P3.

When a high level scan clock signal SCCLK(i+1) together with a high level scan clock signal SCCLK(i) are input for a period P3 to P4, the boosting capacitors CS1 and CS2 bootstrap a voltage of the Q node to a second boosting voltage BL2 level which is higher than that of the first boosting voltage BL1. Accordingly, the gate signal SCOUT (i+1) is output from the third output node NO3 for a period P3 to P4.

When a high level scan clock signal SCCLK(i+2) together with a high level scan clock signal SCCLK(i+1) are input for a period P4 to P5, the boosting capacitors CS2 and CS3 bootstrap the voltage of the Q node to the second boosting voltage BL2 level which is higher than that of the first boosting voltage BL1. Accordingly, the gate signal SCOUT (i+2) is output from the fourth output node NO4 for a period P4 to P5.

When a high level scan clock signal SCCLK(i+3) together with a high level scan clock signal SCCLK(i+2) are input for a period P5 to P6, the boosting capacitors CS3 and CS4 bootstrap the voltage of the Q node to the second boosting voltage BL2 level which is higher than that of the first boosting voltage BL1. Accordingly, the gate signal SCOUT (i+3) is output from the fifth output node NO5 for a period P5 to P6.

For a P6 to P7, only a high level scan clock signal SCCLK(i+3) is input. The boosting capacitor CS4 bootstraps the voltage of the Q node to the first boosting voltage BL1 level.

Further, when a high level carry clock signal CRCLK(k) is input for a period P5 to P7, the first transistor T41 turned on based on the voltage charged to the Q node may allow the carry signal C(k) to be output from the first output node NO1.

Since the scan clock signal is not input for a period P7 to P8, the voltage of the Q node has again been charged to the first high-potential voltage GVDD1 level. Further, when the rear carry signal C(k+2) at a high level is input for the period P7 to P8, the third transistor T23 and the fourth transistor T24 of the Q node controller 504 are turned on. Accordingly, at a time-point P8, the Q node has been discharged to the third low-potential voltage GVSS3 level. When the Q node has been discharged to the third low-potential voltage GVSS3 level, the fourth transistor T44 included in the inverter 508 may be turned off, and the second high-potential voltage GVDD2 may be input to a gate of the first transistor T41 such that the first transistor T41 is turned on. When the first transistor T41 is turned on, the QB node has been charged to the second high-potential voltage GVDD2 level.

In the embodiment shown in FIG. 8 and FIG. 9, the gate driver circuit 13 includes the n gate lines and the k stage circuits corresponding thereto (n>k). Therefore, a smaller number of the stage circuits are included in the gate driver circuit 13 according to the embodiment shown in FIG. 8 and FIG. 9, compared to that in the gate driver circuit 13 according to the embodiment shown in FIG. 4 and FIG. 5.

Further, the gate driver circuit 13 shown in FIG. 8 and FIG. 9 includes a smaller number of the transistors than that in the gate driver circuit 13 according to the embodiment shown in FIG. 4 and FIG. 5. For example, when a display panel 10 including the gate driver circuit 13 shown in FIG. 8 and FIG. 9 and a display panel 10 including the gate driver circuit 13 shown in FIG. 4 and FIG. 5 have the same resolution, the number of the transistors included in the gate driver circuit 13 of the former may be reduced by 71% compared to the number of the transistors included in the gate driver circuit 13 of the latter. Further, the number of the control signals and the number of power supplies required for the operation of the gate driver circuit 13 of the former may be reduced by 58.7% due to the reduction in the number of the transistors, compared to the number of the control signals and the number of power supplies required for the operation of the gate driver circuit 13 of the latter.

As the number of the transistors, and number of the control signals, and the number of the power supplies decrease, an area occupied by the gate driver circuit 13 in the display device 1 also decreases. For example, when a display panel 10 including the gate driver circuit 13 shown in FIG. 8 and FIG. 9 and a display panel 10 including the gate driver circuit 13 shown in FIG. 4 and FIG. 5 have the same resolution, the area of the gate driver circuit 13 of the former may be reduced by 57.3% compared to the area of the gate driver circuit 13 of the latter. Accordingly, the display area of the display device 1 may be increased and thus the non-display area may be decreased, so that the display quality of the display device 1 may be improved.

In one example, the stage circuits of the gate driver circuit 13 shown in FIG. 8 and FIG. 9 do not share the QB node with each other, unlike the gate driver circuit 13 shown in FIG. 4 and FIG. 5. Therefore, the QB node is turned on or off every frame. Accordingly, each of the transistors T31, T32, T62, T72, T74, T76, and T78 connected to the QB node may be turned on or off every frame.

When each of the transistors T31, T32, T62, T72, T74, T76, and T78 connected to the QB node is turned on or off every frame, the transistors T31, T32, T62, T72, T74, T76 and T78 may deteriorate rapidly due to a voltage stress applied to the transistors T31, T32, T62, T72, T74, T76, and T78. The deterioration of the transistor due to the voltage stress applied to the transistor causes the threshold voltage of the transistor to rise up, which causes performance degradation and shortening of the lifespan of the display device 1.

Therefore, in order to reduce the deterioration of each of the transistors T31, T32, T62, T72, T74, T76, and T78 connected to the QB node, the gate driver circuit 13 according to one embodiment of the present disclosure may be configured such that a magnitude of the voltage charged to the QB node, that is, a magnitude of the second high-potential voltage GVDD2 may be adjusted.

Figure 11:
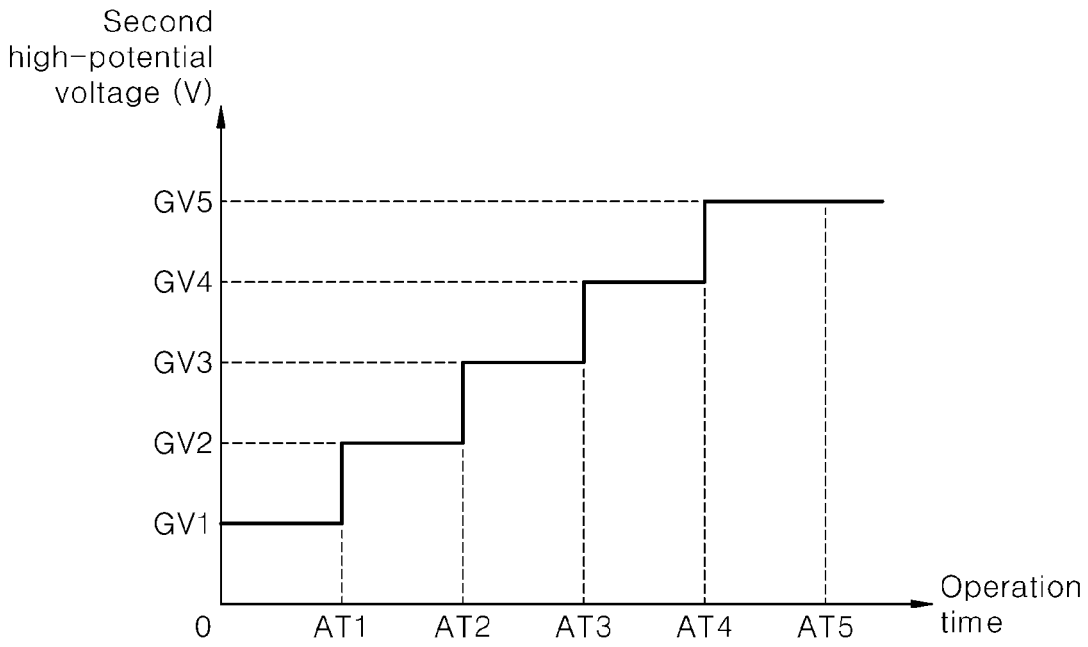
FIG. 11 is a graph showing change in a magnitude of a second high-potential voltage based on an operation time duration of a gate driver circuit in one embodiment of the present disclosure.

FIG. 11 is a graph showing change in the magnitude of the second high-potential voltage based on an operation time duration of the gate driver circuit in one embodiment of the present disclosure. In FIG. 11, a horizontal axis represents the operation time duration of the gate driver circuit 13, and the vertical axis represents the magnitude of the second high-potential voltage GVDD2 shown in FIG. 9.

In one embodiment of the present disclosure, the magnitude of the second high-potential voltage GVDD2 supplied to the QB node shown in FIG. 9 may be adjusted based on the operation time duration of the gate driver circuit 13.

For example, as shown in FIG. 11, as the operation time duration of the gate driver circuit 13 increases, the magnitude of the second high-potential voltage GVDD2 may increase. That is, as shown in FIG. 11, whenever the operation time duration of the gate driver circuit 13 increases to AT1, to AT2, to AT3, to AT4, and to AT5, the magnitude of the second high-potential voltage GVDD2 increases to GV1, to GV2, to GV3, to GV4, and to GV5 in a stepwise manner. In this connection, the magnitudes GV1, GV2, GV3, GV4, and GV5 of the second high-potential voltage GVDD2 may be greater than or equal to a magnitude of a threshold voltage of each of the transistors T31, T32, T62, T72, T74, T76, and T78 connected to the QB node at the operation time durations AT1, AT2, AT3, AT4, and AT5, respectively, and may be determined experimentally.

In one example, FIG. 11 shows an embodiment in which the magnitude of the second high-potential voltage GVDD2 increases stepwise as the operation time duration of the gate driver circuit 13 increases. However, in another embodiment of the present disclosure, the magnitude of the second high-potential voltage GVDD2 may increase linearly or non-linearly in proportion to the operation time duration of the gate driver circuit 13.

Further, each of AT1, AT2, AT3, AT4, and AT5 and each of GV1, GV2, GV3, GV4, and GV5 shown in FIG. 11 may vary based on embodiments and may be determined experimentally.

Further, spacings between adjacent ones of AT1, AT2, AT3, AT4, and AT5 and spacings between adjacent ones of GV1, GV2, GV3, GV4, and GV5 shown in FIG. 11 may be the same as or different from each other. For example, a difference value between AT2 and AT1 may be set to be the same as or different from a difference value between AT5 and AT4. In still another example, a difference value between GV3 and GV2 may be set to be the same as or different from a difference value between GV5 and GV4.

As shown in FIG. 11, increasing the magnitude of the second high-potential voltage GVDD2 in proportion to the operation time duration of the gate driver circuit 13 may allow a normal operation of the gate driver circuit 13 to be guaranteed, and may allow the voltage stress applied to each of the transistors T31, T32, T62, T72, T74, T76, and T78 connected to the QB node to be reduced. Accordingly, the lifespan of the display device 1 may be extended.

Figure 12:
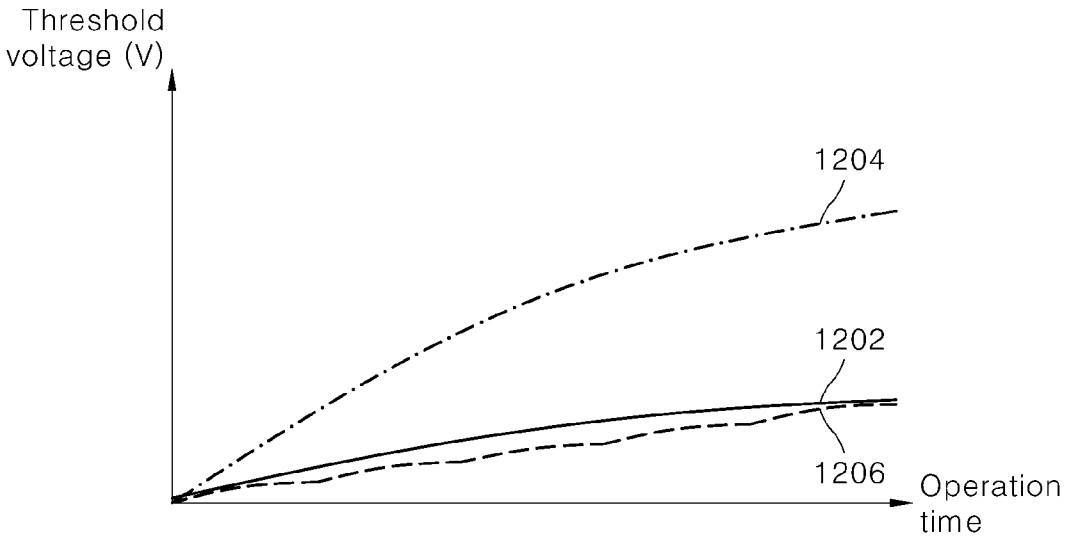
FIG. 12 is a graph showing change in a magnitude of a threshold voltage of a transistor based on an operation time duration of a gate driver circuit.

FIG. 12 is a graph showing change in a magnitude of a threshold voltage of a transistor based on an operation time duration of the gate driver circuit.

In FIG. 12, data 1202 shows change in a magnitude of a threshold voltage of each of the transistors connected to the QB_o node and the QB_e node of the gate driver circuit 13 shown in FIG. 4 and FIG. 5.

Further, data 1204 in FIG. 12 shows change in a magnitude of a threshold voltage of each of the transistors connected to the QB node when the second high-potential voltage GVDD2 supplied to the QB node in the gate driver circuit 13 shown in FIG. 8 and FIG. 9 always has a constant magnitude.

Further, in FIG. 12, data 1206 shows change in a magnitude of a threshold voltage of each of the transistors connected to the QB node when the magnitude of the second high-potential voltage GVDD2 in the gate driver circuit 13 shown in FIG. 8 and FIG. 9 increases based on the operation time duration of the gate driver circuit 13.

As may be seen based on the data 1202 in FIG. 12, the transistors connected to the QB_o node and the QB_e node in the gate driver circuit 13 shown in FIG. 4 and FIG. 5 may be alternately turned on or off in each frame (the odd-numbered frame and the even-numbered frame). Accordingly, the threshold voltage increase speed, that is, the deterioration speed of each of the transistors connected to the QB_o node and the QB_e node is relatively low.

In one example, as may be seen based on the data 1204 in FIG. 12, when the second high-potential voltage GVDD2 supplied to the QB node in the gate driver circuit 13 shown in FIG. 8 and FIG. 9 always has the same magnitude, the magnitude of the threshold voltage of each of the transistors connected to the QB node increases rapidly. Accordingly, each of the transistors connected to the QB node may be rapidly deteriorated, and thus the lifespan of the display device 1 may be shortened.

However, as may be seen based on the data 1206 in FIG. 12, when the magnitude of the second high-potential voltage GVDD2 in the gate driver circuit 13 shown in FIG. 8 and FIG. 9 is adjusted based on the operation time duration of the gate driver circuit 13, the increase speed of the magnitude of the threshold voltage of each of the transistors connected to the QB node may be significantly lower, compared to that when the second high-potential voltage GVDD2 supplied to the QB node in the gate driver circuit 13 shown in FIG. 8 and FIG. 9 always has the same magnitude. Therefore, the lifespan of the display device 1 may be extended.

Although the embodiments of the present disclosure have been described in more detail with reference to the accompanying drawings, the present disclosure is not necessarily limited to these embodiments. The present disclosure may be implemented in various modified manners within the scope not departing from the technical idea of the present disclosure. Accordingly, the embodiments disclosed in the present disclosure are not intended to limit the technical idea of the present disclosure, but to describe the present disclosure. the scope of the technical idea of the present disclosure is not limited by the embodiments. Therefore, it should be understood that the embodiments as described above are illustrative and non-limiting in all respects. The scope of protection of the present disclosure should be interpreted by the claims, and all technical ideas within the scope of the present disclosure should be interpreted as being included in the scope of the present disclosure.

What is claimed is:

1. A gate driver circuit for a display device comprising: a plurality of stage circuits, wherein at least one stage circuit from the plurality of stage circuits supplies a gate signal to a gate line, the at least one stage circuit including: a plurality of nodes comprising a M node, a Q node, a QH node, and a QB node; a line selector configured to: charge the M node based on a front carry signal responsive to an input of a line sensing preparation signal; and charge the Q node to a first high-potential voltage level responsive to an input of a reset signal or discharge the Q node to a third low-potential voltage level responsive to an input of a panel on signal; a Q node controller configured to: charge the Q node to the first high-potential voltage level responsive to an input of the front carry signal; and discharge the Q node to the third low-potential voltage level responsive to an input of a rear carry signal; a Q node and QH node stabilizer configured to discharge each of the Q node and the QH node to the third low-potential voltage level responsive to the QB node being charged to a second high-potential voltage; an inverter configured to change a voltage level of the QB node based on a voltage level of the Q node; a QB node stabilizer configured to discharge the QB node to the third low-potential voltage level responsive to an input of the rear carry signal, an input of the reset signal, and a charged voltage of the M node; a carry signal output module configured to output a carry signal based on a carry clock signal or the third low-potential voltage and based on the voltage level of the Q node or the voltage level of the QB node; and a gate signal output module configured to output first to j-th gate signals based on first to j-th scan clock signals or a first low-potential voltage and based on the voltage level of the Q node or the voltage level of the QB node.

2. The gate driver circuit of claim 1, wherein the gate signal output module is configured to sequentially output the first to j-th gate signals based on the first to j-th scan clock signals responsive to the voltage level of the Q node being at a high level.

3. The gate driver circuit of claim 1, wherein the gate signal output module includes:

a pull-up transistor configured to turn on responsive to the voltage level of the Q node being at a high level and supply the first to j-th scan clock signals to an output node responsive to being turned on;

a pull-down transistor configured to turn on responsive to the voltage level of the QB node being at the high level and supply the first low-potential voltage to the output node responsive to being turned on; and a boosting capacitor connected to and disposed between a gate electrode and a source electrode of the pull-up transistor.

4. The gate driver circuit of claim 3, wherein the pull-down transistor is turned on responsive to the voltage level of the QB node being charged to the second high-potential voltage.

5. The gate driver circuit of claim 1, wherein the Q node and QH node stabilizer includes a first transistor and a second transistor configured to be turned on responsive to the QB node being charged to the second high-potential voltage.

6. The gate driver circuit of claim 1, wherein a magnitude of the second high-potential voltage is adjusted based on an operation time duration of the gate driver circuit.

7. The gate driver circuit of claim 6, wherein the magnitude of the second high-potential voltage increases as the operation time duration of the gate driver circuit increases.

8. The gate driver circuit of claim 6, wherein the magnitude of the second high-potential voltage is increased in proportion to the operation time duration of the gate driver circuit.

9. A display device comprising: a display panel including sub-pixels respectively disposed at intersections between gate lines and data lines; a gate driver circuit configured to supply a scan signal to each gate line from the gate lines; a data driver circuit configured to supply a data voltage to each data line from the data lines; and a timing controller configured to control an operation of each of the gate driver circuit and the data driver circuit, wherein the gate driver circuit includes a plurality of stage circuits, wherein at least one stage circuit from the plurality of stage circuits supplies a gate signal to a gate line from the gate lines, the at least one stage circuit including: a plurality of nodes including a M node, a Q node, a QH node, and a QB node, a line selector configured to: charge the M node based on a front carry signal responsive to an input of a line sensing preparation signal; and charge the Q node to a first high-potential voltage level responsive to an input of a reset signal or discharge the Q node to a third low-potential voltage level responsive to an input of a panel on signal; a Q node controller configured to: charge the Q node to the first high-potential voltage level responsive to an input of the front carry signal; and discharge the Q node to the third low-potential voltage level responsive to an input of a rear carry signal; a Q node and QH node stabilizer configured to discharge each of the Q node and the QH node to the third low-potential voltage level responsive to the QB node being charged to a second high-potential voltage; an inverter configured to change a voltage level of the QB node based on a voltage level of the Q node; a QB node stabilizer configured to discharge the QB node to the third low-potential voltage level responsive to an input of the rear carry signal, an input of the reset signal, and a charged voltage of the M node; a carry signal output module configured to output a carry signal based on a carry clock signal or the third low-potential voltage and based on the voltage level of the Q node or the voltage level of the QB node; and a gate signal output module configured to output first to j-th gate signals based on first to j-th scan clock signals or a first low-potential voltage and based on the voltage level of the Q node or the voltage level of the QB node.

10. The display device of claim 9, wherein the gate signal output module is configured to sequentially output the first to j-th gate signals based on the first to j-th scan clock signals responsive to the voltage level of the Q node being at a high level.

11. The display device of claim 9, wherein the gate signal output module includes:

a pull-up transistor configured to turn on responsive to the voltage level of the Q node being at a high level and supply the first to j-th scan clock signals to an output node responsive to being turned on;

a pull-down transistor configured to turn on responsive to the voltage level of the QB node being at the high level and supply the first low-potential voltage to the output node responsive to being turned on; and a boosting capacitor connected to and disposed between a gate electrode and a source electrode of the pull-up transistor.

12. The display device of claim 11, wherein the pull-down transistor is turned on responsive to the voltage level of the QB node being charged to the second high-potential voltage.

13. The display device of claim 9, wherein the Q node and QH node stabilizer includes a first transistor and a second transistor configured to be turned on responsive to the QB node being charged to the second high-potential voltage.

14. The display device of claim 9, wherein a magnitude of the second high-potential voltage is adjusted based on an operation time duration of the gate driver circuit.

15. The display device of claim 14, wherein the magnitude of the second high-potential voltage increases as the operation time duration of the gate driver circuit increases.

16. The display device of claim 14, wherein the magnitude of the second high-potential voltage is increased in proportion to the operation time duration of the gate driver circuit.

17. A gate driver circuit for a display device comprising:

a plurality of stage circuits, wherein at least one stage circuit from the plurality of stage circuits is configured to supply a gate signal to a gate line, the at least one stage circuit including:

a plurality of transistors arranged to form a plurality of nodes between the plurality of transistors, the plurality of nodes including a Q node, a QH node, and a QB node;

wherein the Q node is configured to be charged and discharged between a first high-potential voltage and a third low-potential voltage, wherein the QH node is configured to be charged and discharged between the third low-potential voltage and a second high-potential voltage, a magnitude of the second high-potential voltage adjusted based on an operation time duration of the gate driver circuit; and wherein the QB node is configured to be charged and discharged between a voltage of the Q node and the third-low potential voltage.

18. The gate driver circuit of claim 17, wherein the magnitude of the second high-potential voltage increases as the operation time duration of the gate driver circuit increases.

19. The gate driver circuit of claim 18, wherein the magnitude of the second high-potential voltage is increased in proportion to the operation time duration of the gate driver circuit.

20. The gate driver circuit of claim 17, wherein at least one stage circuit from the plurality of stage circuits is configured to supply a plurality of gate signals to a plurality of gate lines.

* * * * *